US007196324B2

(12) United States Patent
Verentchikov

(10) Patent No.: US 7,196,324 B2
(45) Date of Patent: Mar. 27, 2007

(54) TANDEM TIME OF FLIGHT MASS SPECTROMETER AND METHOD OF USE

(75) Inventor: Anatoli N. Verentchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 39 days.

(21) Appl. No.: 10/520,871

(22) PCT Filed: Apr. 29, 2003

(86) PCT No.: PCT/US03/13262

§ 371 (c)(1),
(2), (4) Date: Jan. 11, 2005

(87) PCT Pub. No.: WO2004/008481

PCT Pub. Date: Jan. 22, 2004

(65) Prior Publication Data

US 2005/0242279 A1 Nov. 3, 2005

(30) Foreign Application Priority Data

Jul. 16, 2002 (GB) ..... 0216438.2

(51) Int. Cl.
*H01J 49/40* (2006.01)

(52) U.S. Cl. ..... 250/287

(58) Field of Classification Search ..... 250/287, 250/286, 296, 282

See application file for complete search history.

(56) References Cited

U.S. PATENT DOCUMENTS 4,963,736 A 10/1990 Douglas et al.
5,032,722 A 7/1991 Boesl et al.
5,202,561 A 4/1993 Giessmann et al.

(Continued)

FOREIGN PATENT DOCUMENTS

WO WO 9214259 8/1992

(Continued)

OTHER PUBLICATIONS

Bakker, J.M.B., "The Spiratron," *In Mass Spectrom*, London, 1971, pp. 278-282.

Morris et al., "High Sensitivity Collisionally-activated Decomposition Tandem Mass Spectrometry on a Novel Quadrupole/Orthogonal-acceleration Time-of-flight Mass Spectrometer," *Rapid Communications in Mass Spectrometry*, vol. 10, 1996, pp. 889-896.

(Continued)

*Primary Examiner*—Kiet T. Nguyen
(74) *Attorney, Agent, or Firm*—Price, Heneveld, Cooper, DeWitt & Litton, LLP

(57) ABSTRACT

To provide comprehensive MS—MS analysis, a time-nested separation is employed using two time-of-flight (TOF) mass spectrometers. Parent ions are separated in a slow and long TOF1, operating at low ion energy (1 to 100eV), and fragment ions are mass analyzed in a fast and short TOF2, operating at much higher keV energy. A low energy fragmentation cell between TOF1 and TOF2 is tailored to accelerate fragmentation and dampening steps, mostly by shortening the cell and employing higher gas pressure. Slow separation in TOF1 becomes possible with an introduction of novel TOF1 analyzers. Higher performance is expected with the use of novel hybrid TOF1 analyzers, combining radio frequency (RF) and quadratic DC fields. An RF field retains low-energy ions within a TOF1 analyzer, while a quadratic DC field improves resolution by compensating for a large relative energy spread.

39 Claims, 9 Drawing Sheets

U.S. PATENT DOCUMENTS

| | | | | |
|---|---|---|---|---|
| 5,464,985 | A | 11/1995 | Cornish et al. | |
| 5,811,800 | A | 9/1998 | Franzen et al. | |
| 5,847,386 | A | 12/1998 | Thomson et al. | |
| 5,854,485 | A | 12/1998 | Bergmann | |
| 6,020,586 | A | 2/2000 | Dresch et al. | |
| 6,111,250 | A | 8/2000 | Thomson et al. | |
| 6,166,378 | A | 12/2000 | Thomson et al. | |
| 6,300,627 | B1 | 10/2001 | Köster et al. | |
| 6,670,606 | B2 * | 12/2003 | Verentchikov et al. ..... | 250/287 |

FOREIGN PATENT DOCUMENTS

| | | |
|---|---|---|
| WO | WO 9901889 | 1/1999 |
| WO | WO 9939368 | 8/1999 |
| WO | WO 9940610 | 8/1999 |
| WO | WO 0070335 | 11/2000 |
| WO | WO 0077823 | 12/2000 |
| WO | WO 0115201 | 3/2001 |

OTHER PUBLICATIONS

Qian et al., "Capillary Liquid Chromatography Coupled with an Ion Trap Storage/Reflectron Time-of-flight Mass Spectrometer for Structural Confirmation of Three Recombinant Protein Isoforms," *Rapid Communications in Mass Spectrometry*, vol. 10, 1996, pp. 1079-1087.

Makarov et al., "Pitfalls on the Road to the Ideal Time-of-flight Mirror: Ideal Time-focusing in the Second Stage of Tandem Mass Spectrometers," *Int. J. of Mass Spectrom. And Ion Processes*, vol. 146/147, 1995, pp. 165-182.

Verentchikov et al., "Collisional Cooling and Ion Formation Processes in Orthogonal MALDI at Intermediate Gas Pressure," ASMS Conference 1999.

* cited by examiner

SID

TANDEM TIME OF FLIGHT MASS SPECTROMETER AND METHOD OF USE

CLAIM OF PRIORITY

This application claims priority from United Kingdom patent application Number 0216438.2, filed Jul. 16, 2002.

BACKGROUND OF THE INVENTION

The invention relates to the area of mass spectrometry and, more particularly, is concerned with a method of high-throughput, comprehensive tandem mass spectrometry in apparatus, including two time-of-flight mass spectrometers.

Mass spectrometers are devices which vaporize and ionize a sample and then use static or dynamic electric fields to measure the mass-to-charge ratios of the ions formed. Tandem mass spectrometry is used for structural analysis and the identification of compounds in complex mixtures. In every application the MS-MS procedure has the same sequence of operations:

mass selection of parent ions of a single mass-to-charge ratio (m/z);

fragmentation of those ions; and mass analysis of the fragments.

Although there is a large variety of tandem MS-MS instruments with their own strength and weakness, all of them have one common feature—all of them use one parent ion at a time. The rest of ion species are removed out of the primary ion beam and lost.

Triple quadrupole instruments are the most common MS-MS instrument. A continuous ion source, e.g., electrospray (ESI), introduces ions into a first quadrupole mass filter, which is tuned, such that only ions of interest pass the mass filter. The rest of the primary beam components are rejected and lost. Selected ions are transmitted into a so-called "collision induced dissociation" (CID) cell, filled with gas at mtorr pressures and equipped with a radio frequency (RF) quadrupole guide. The kinetic energy of the injected ions is controlled by an electrostatic bias on the mass filter and is adjusted to induce ion fragmentation via gas collisions. Fragment ions are collisional dampened in a CID cell and then introduced into a second quadrupole for mass analysis. Since mass scanning in a second quadrupole takes time and causes additional ion losses by factor of c.a. 1000, triple quadrupole instruments are mostly used for detection of known species with known masses of parent and fragment ions.

The introduction of quadrupole time-of-flight tandem mass spectrometers (Q-TOF) strongly enhanced throughput of MS-MS instruments (see Morris et al., Rap. Comm. Mass. Spectrom., v. 10, pp. 889–896, 1996). The triple quadrupole was modified, such that the second quadrupole mass filter was replaced by an orthogonal TOF MS (oa-TOFMS). This substitution gave an advantage of parallel analysis of all fragment ions at once and, hence, higher sensitivity and faster acquisition in a second MS, as well as enhanced resolution and mass accuracy of a second MS. However, the quadrupole is still used for parent ion selection, accompanied by rejection of all ion species but one. The idea of parallel analysis has not been extended parent ions.

Another common MS—MS device uses Paul ion trap mass spectrometer (ITMS), well described in March, R. E., Hughes R, J. Quadrupole storage mass spectrometry, Willey-Interscience, New York 1989. Ions, produced in the ion source, are periodically injected into an ITMS and are trapped within the ITMS by a radio frequency (RF) field. "Unwanted" species are removed, e.g., by applying a broadband resonant AC signal, so that only ions of interest remain in the trap. Selected parent ions are then excited by a separate AC field, resonant with the secular motion of the precursor. Parent ions gain kinetic energy and fragment in energetic collisions with a buffer gas. Fragments are mass analyzed using a resonant ejection technique. The amplitude of an RF field is ramped such that ions leave the trap sequentially according to their m/z values.

It also has been known to couple a 3-D Paul trap with a TOF analyzer for more accurate mass analysis of fragment ions. See Quin and D. Lubman, Rap. Comm. Mass. Spectrom., 10, 1079, 1996 and WO 99/39368 by Shimadzu. A linear ion trap (LIT) has been coupled to a TOF analyzer in U.S. Pat. No. 5,847,386 by Thomson et al., U.S. Pat. No. 6,111,250 by B.A. Thomson and L.L. Joliffe, U.S. Pat. No. 6,020,586 by T. Dresch et al. and WO 01/15201 by B. Reinhold and A. Verentchikov. All ion trap tandems are mostly oriented on multiple stage MS—MS analysis. Parent ions are selected with a loss of other ion components.

Recently introduced tandem time-of-flight mass spectrometers (TOF—TOF) are the closest prototypes to the below described invention by similarity of employed hardware. Examples of TOF—TOF are described in U.S. Pat. No. 5,032,722 by Schlag et al., U.S. Pat. No. 5,464,985 by T. J. Kornish et al., U.S. Pat. No. 5,854,485 by T. Bergmann, WO 99/40610 by M. L. Vestal, and WO 99/01889 by C. Hop. In all TOF—TOF tandems, a pulsed ion beam is time separated in a first, high-energy TOF and filtered by timed ion selector, so that only ions of interest pass into the CID cell. The CID cell is filled with gas at a low gas pressure (usually below 1 mtorr) to induce single high energy collisions with the buffer gas sufficient for ion fragmentation, but still retaining short duration to maintain an ion packet. A pulsed beam of fragment ions is analyzed in a second, high energy TOF. To handle the large energy spread of the fragment ions, the second TOF employs either quadratic field potential or an additional pulsed acceleration.

In WO 00/77823 by A. Verentchikov, a variation of TOF—TOF tandem employs slow injection of parent ions into a CID cell with collisional dampening of fragments and subsequent injection into an orthogonal TOF. The instrument is the closest prototype of the invention, considering employed components. Collisional dampening in the fragmentation cell improves ion beam characteristics upstream of the second TOF and allows high resolution and accurate measurements of fragment ion masses. The first TOF operates at 1 kV energy and a short time scale. A time gate in front of a CID cell admits only one parent ion mass at a time.

In all described tandems the first mass analyzer (either quadrupole, ion trap or TOF) selects one parent ion mass at a time and rejects all other components. In some applications, like drug metabolism studies, it is acceptable to follow a single compound of interest. In the case of complex mixtures (like protein characterization out of gels), however, it is necessary to analyze multiple parent ions. Using existing techniques, sequential MS—MS analysis of multiple precursors is tedious and insensitive.

Recently introduced tandem IMS-CID-TOF mass spectrometers employ a principle of time-nested acquisition, potentially to be implemented without ion losses. See WO 00/70335 by D. Clemmer. Since separation in the ion mobility spectrometer (IMS) occurs in milliseconds and TOF mass spectrometry in microseconds, it is possible to acquire fragment spectra for each ion mobility fraction. The disadvantage of the technique is a poor IMS separation with mobility resolution below R=50, which corresponds to mass resolution of about 10. Since IMS-TOF tandem employs a principle of comprehensive tandem mass spectrometry with time-nested acquisition, it is selected as a prototype of the invention.

The idea of MS—MS analysis without parent ion losses is also disclosed in WO 01/15201 by B. Reinhold and A. Verentchikov. Ions are selected by resonant excitation and moved between ion traps without rejecting other ionic components. The procedure is tedious and long, while ions from the ion source are lost. So-called parallel ion processing is employed in multiple ion traps in WO 92/14259 by Kirchner, where the beam is split between multiple traps. Time is saved by sacrificing sensitivity.

There is still a need for an instrument providing rapid and sensitive MS—MS analysis for multiple parent ions in parallel without rejecting ions coming from an ion source. Such an instrument would further improve a throughput of MS—MS analysis, desirable in analysis of complex mixtures.

SUMMARY OF THE INVENTION

The inventor has realized, that one can implement the principle of nested time separation using two time-of-flight (TOF) mass spectrometers-a slow TOF1 for parent ion separation and a fast TOF2 for fragment mass analysis. Thus, the tandem mass spectrometry of the invention employs two time-of-flight separations, wherein for the same mass-to-charge ratio, flight time in the first separation step is much longer than flight time in the second separation step and multiplicity of parent ions are separated, fragmented and mass analyzed per single ion injection from the ion source.

The tandem mass spectrometer of the invention comprises a pulsed ion source, a time-of-flight mass spectrometer (TOF1) for time separation of the parent ions, a fragmentation cell, a second time-of-flight mass spectrometer (TOF2) for mass analysis of the fragment ions and a data acquisition system. Contrary to prior TOF—TOF systems, flight time in the TOF1 is substantially greater than the combined passage time through the fragmentation cell and the flight time in the TOF2. Prolonged separation in TOF1, typically in the millisecond range, could be achieved by operating longer TOF1 at much lower kinetic energy, typically around 1 to 100eV, while using shorter TOF2 at 3 to 10 keV energy. Time between arrivals of adjacent parent ion species becomes sufficient to fragment and mass analyze fragments. Thus, the invention allows rapid MS—MS analysis of multiple parent ions in real time without rejecting parent ions. The MS—MS acquisition cycle lasts a few milliseconds and can be repeated multiple times to improve sensitivity and signal quality.

To avoid ion losses the ion source is operated in a pulsed mode at about 100 Hz repetition rate, compatible with millisecond time of MS—MS cycle. A Matrix Assisted Laser Desorption/Ionization (MALDI) ion source is one example of a usable pulsed ion source. The invention is also compatible with a wide variety of continuous ion sources, like ESI, MALDI with gas cooling, Chemical Ionization and gas filled Photo-ionization ion sources. Ion flow is continuously accumulated within storage radio frequency (RF) device and is periodically pulse ejected into the TOF1. The said storage device can be either Paul trap or storage multipole, preferably quadrupole.

To the best knowledge of the author, the novel time-nested TOF—TOF method can not be implemented on existing TOF—TOF instruments without severe sacrifice of performance. The invention discloses several novel TOF1 separators, operating at lower ion energies (1 to 100 eV) to expand separation time.

Two of those novel TOF1 analyzers employ a combination of a confining radio frequency (RF) field with a DC quadratic field, providing temporal focusing of the ion beam with a relatively large energy spread. Those analyzers are capable of operating at a particularly low ion energy ranging from 1 to 10 eV. In one preferred embodiment, the novel TOF1 analyzer comprises a linear multipole ion guide, preferably quadrupole, surrounded by DC mirrors. DC mirrors on both ends are turned on and off to provide ion injection from one TOF1 end, and multiple ion reflections and subsequent ion release from another end. In another preferred embodiment, the novel TOF1 analyzer comprises two external rows of DC electrodes and two internal rows of RF-only rods, oriented across TOF1 axis. The structure forms a two-dimensional RF-tunnel combined with quadratic potential distribution along the TOF axis. Ions are injected into the TOF1 at a small angle to the axis, experience multiple reflections along the axis, slowly shift across the axis and leave TOF1 after several reflections.

Another three novel analyzers are electrostatic devices, operating at medium energy around 100 eV. One of them, a "spiratron" comprises a pair of coaxial cylindrical electrodes with DC voltage applied between them. Ions are injected between the electrodes at a small angle to their axis. Medium energy (100 eV) ions turn around central electrodes while drifting slowly along the axis. After a number of turns, ions leave TOF1 through a cut-off boundary, which is formed by a double-sided printed circuit board to avoid DC field disturbance. Other two electrostatic separators are planar and cylindrical multi-pass analyzers, employing grid-less mirrors, simultaneously acting like a lens. The effective flight path is extended by use of a multi-pass mode, so that a 10 ms time scale is achieved despite of a higher energy (compared to RF assisted TOF1).

The invention is compatible with a variety of fragmentation methods including gas collisions and collisions with surface and by light. The design of fragmentation cells is trimmed to reduce transmission time and time spread. The CID cell is short (around 1 cm), filled with gas at a relatively high pressure (above 0.1 mbar) and supplemented by an axial DC field to accelerate transmission and to modulate the ion beam synchronous with TOF2. The surface induced dissociation (SID) cell uses a pulsed lens to provide spatial focusing together with temporal focusing (bunching). Ions are ejected out of the SID cell by pulsing the probe potential, synchronized (though with time shift) with the bunching lens and TOF2 pulses.

Though the choice of the second time-of-flight analyzer is not critical, the TOF with orthogonal ion injection (o-TOF) is more suitable in a majority of tandem examples. In order to improve the efficiency of orthogonal injection (so-called duty cycle), it is preferred to eject ions out of the fragmentation cell synchronous and slightly prior to the orthogonal injection pulses.

The TOF—TOF tandem of the present invention is expected to separate parent ions at a moderate resolution, mostly limited by speed of the second TOF MS, e.g., 10 μs. The estimated resolution of TOF1 on the order of 300 (see detailed description) is still sufficient to isolate a group of isotopes of parent ions and is much higher than the resolution of parent separation in the prior art ion mobility spectrometer. Higher resolution of separation could be achieved in longer TOF1 or by periodic selection of ions by a time gate in front of the CID cell.

The invention permits multiple strategies for data acquisition. In a simple and robust approach, MS—MS data are acquired continuously and MS—MS spectra of multiple parent ions are reconstructed afterwards. It is wiser, though, to perform MS—MS analysis in two stages. At first, MS-only stage parent ions are continuously admitted into the TOF2 for mass analysis of parent ions. Information on masses of parent ions is used for a second MS—MS stage. The time gate opens only at a time of arrival of multiple parents of interest to improve the resolution of parent ion separation and to avoid signals from chemical background. The TOF2 signal is also acquired for selected time windows only to reject meaningless data flow. Similar information on parent ions may be obtained using an optional on-line detector located anywhere after TOF1.

In addition to highly sensitive and rapid MS—MS analysis, the invention provides multiple types of MS-only analysis. TOF1 alone can be used for MS only analysis for the sake of spreading peaks in time, avoiding detector saturation and using an inexpensive and slow transient recorder. A better quality spectrum of parent ions could be acquired in TOF2 while using TOF1 in a pass mode. So-called "Parent scan", i.e. spectrum of parent ions having a set of specific fragments, can be reconstructed from MS—MS data, averaged in multiple source injections. The data could be finally stored for parents' masses only.

Since MS/MS spectra are acquired for all precursor ions of interest in a single ion injection, the invention provides an exceptional speed of MS/MS analysis, estimated as 10 to 30 full cycles a second. The speed of MS—MS analysis is compatible with the time scale of chromatographic separation, thus, a real time LC-MS—MS analysis is possible without any prior limitations, such as "data dependent acquisition," currently employed in ion traps and Q-TOFs. High acquisition speed and sensitivity of the invented MS—MS tandem also opens an opportunity for using nested LC—LC analysis up-front.

BRIEF DESCRIPTION OF THE DRAWINGS

This invention is pointed out with particularity in the appended claims. The above and further advantages of this invention may be better understood by referring to the following description taken in conjunction with the accompanying drawings in which:

DETAILED DESCRIPTION OF THE EMBODIMENTS

A method of tandem mass spectrometry analysis of the invention comprises the steps of:

- generating an ion pulse in an ion source, containing a mixture of different analyte ions;
- separating the analyte ions according to time of flight within a first time-of-flight mass spectrometer, and, thus, generating a train of ion packets in a sequence of their masses;
- sequentially fragmenting the analyte ions without mixing the separated ion packets;
- rapidly mass analyzing the fragmented ions within a second time-of-flight mass spectrometer at a time scale much shorter than a time scale of the first separation step;
- acquiring fragment mass spectra for multiple analyte ion mass-to-charge ratios at a single ion pulse out of the ion source; and,
- optionally, summing the fragment spectra for each of the analyte ions over multiple source pulses.

Fundamental to the method is arranging the separation time in the first TOF much longer than fragmentation time and time of fragment mass analysis for the same mass-to-charge ratio. Substantial difference in time scales is utilized to separate, fragment and mass-analyze fragments for multiplicity of parent ions per single ion injection out of the ion source. The substantial difference in time scale is achieved by a longer flight path and/or lower ion energy in the first TOF.

Figure 1:
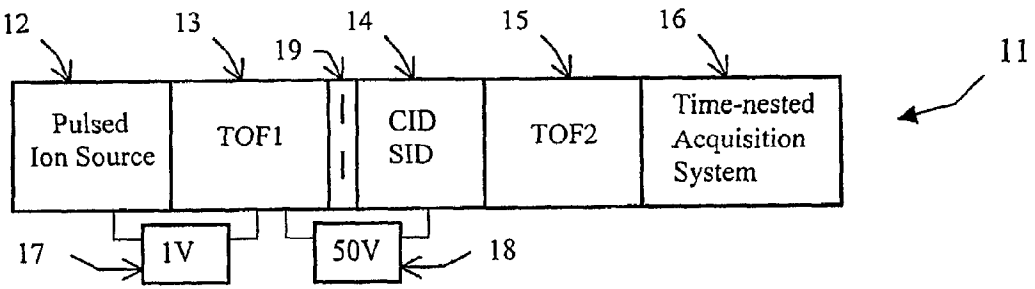
FIG. 1 is a block diagram, illustrating the method of the invention.

Referring to FIG. 1, the method is illustrated by a block diagram of the major tandem MS—MS components. The generic TOF—TOF instrument with time-nested acquisition 11 comprises a sequentially communicating pulsed ion source 12, a first time-of-flight mass spectrometer TOF1 13, a fragmentation cell CID/SID 14, a second time-of-flight mass spectrometer TOF2 15 and a data system 16 for time-nested acquisition. The pulsed ion source is biased compared to the TOF1 spectrometer at a small potential difference by voltage supply 17, and the TOF1 is biased compared to the CID cell at a potential difference by voltage supply 18. An optional timed gate 19 may be inserted between the TOF1 13 and the CID cell 14 to enhance TOF1 separation.

Briefly, in operation, the pulsed ion source generates an ion pulse of analyte (parent) ions and injects ions into the TOF1 at a reduced energy, typically between 1 to 10 eV, controlled by a voltage supply 17. This is an important difference between the current invention and the prior art, since TOF spectrometers are usually operated at energies between 3 and 30 keV. Separation in TOF1 occurs in several milliseconds. As a guiding example, let us consider the effective length of TOF1 L1=8 m, ions energy E=3 eV and ion mass m=1000 a.m.u. In this example, ion velocity is V=800 m/s and the flight time is 10 ms. Time-separated parent ions are sequentially ejected out of TOF1 into the CID cell at an increased energy level controlled by a DC bias between TOF1 and the cell. Energetic collisions with the gas molecules convert the parent ions into fragments. Subsequent gas collisions cause collisional dampening of fragment ions. Fragments rapidly travel through the cell and are injected into the TOF2 spectrometer. TOF2 separates fragment ions at a much shorter time scale, between 10 and 100 μs. Drastic difference in time scales of TOF1 and TOF2 allows data acquisition of multiple fragment spectra, corresponding to different parent ions between source pulses. The specialized data acquisition system 16 acquires multiple fragment spectra in a time-nested fashion, where individual spectra are not mixed together. Fragment spectra for each parent ion are integrated over a number of ion source pulses. Thus, ion pulse, generated in the ion source, is used for acquiring a full set of MS—MS data for multiple parents without rejecting ions at all stages.

Figure 2:
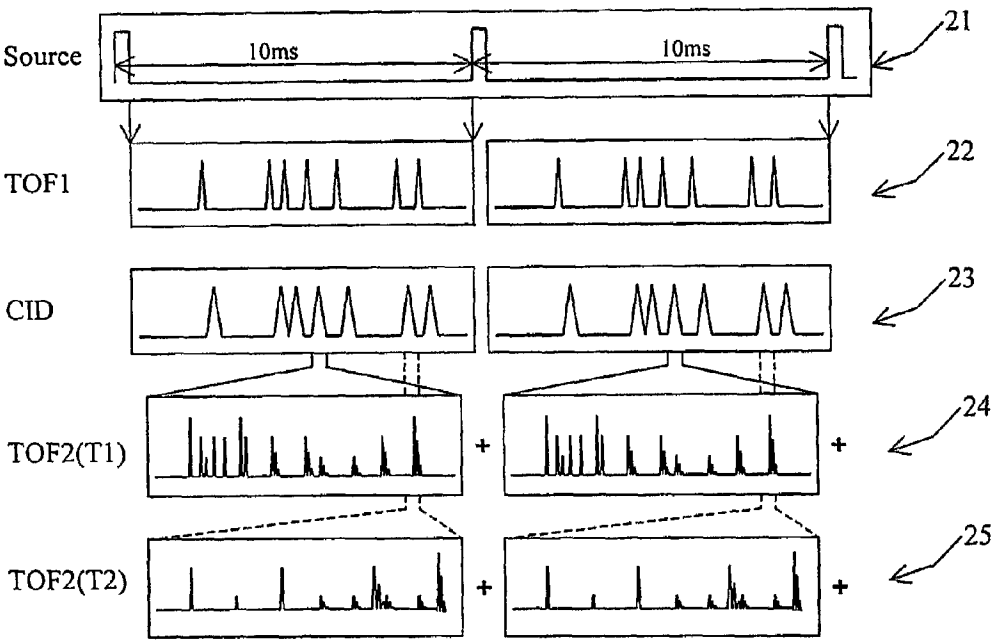
FIG. 2 is a timing diagram of operation of tandem TOF—TOF mass spectrometer.

Referring to FIG. 2, a typical time diagram illustrates the method of the invention, synchronization of individual devices and a principle of time-nested data acquisition. The top graph 21 presents an acquisition cycle, where ion injections occur every 10 ms, i.e. 100 times a second. Parent ions are separated in the TOF1 within 10 ms time, and the CID cell receives a train of ion packets, aligned in accordance with parent ion mass, graph 22. Parent ions are partially fragmented in the cell, and because of a short transmission time in the cell, fragments arrive at TOF2 almost simultaneously with their parents, graph 23. Each new family of ions (i.e. parents and daughters) is orthogonally pulsed into the high energy TOF2 every 10 μs, producing TOF2 spectra for each parent mass-graph 24. Each TOF2 spectrum obtains a time tag of TOF2 pulse relative to source pulse, i.e. TOF1 time tag. The spectra with the same TOF1 time tag are, summed over multiple ion source pulses, as shown by dashed lines, connecting two TOF2 spectra with the same TOF1 time tag.

In the above described operation mode, the time-nested acquisition is done in a straightforward way. Instrument operation parameters remain the same, regardless of the ion beam composition from the ion source, and data are acquired all the time. All the information, like parent ion spectra and fragment spectra for various parents, is extracted in a subsequent data analysis.

In another operation mode, which should be called "data dependent acquisition," MS—MS analysis occurs in two steps. In the first step, mass spectrum of parents is acquired in a TOF2, while TOF1 and CID cell pass ions continuously without fragmentation. In the second step, the instrument is operated as MS—MS, i.e., the TOF1 separates parent ions, the fragmentation cell forms fragments, and the TOF2 acquires fragment mass spectra in the time-nested data fashion. The time-nested acquisition is enhanced by utilizing the information on the parent ion masses and avoiding data acquisition at blank times, when no parents are coming. An optional timed gate 19 may be used to enhance TOF1 separation as well as suppression of chemical noise. It is naturally expected that ion packets coming out of TOF1 are shorter than the same ion packet at the exit of the CID cell. The timed gate admits ions only at multiple narrow time windows, corresponding to arrival of parent ions. Such gating suppresses ion signals coming from chemical backgrounds and improves detection limit. Gate operation may also be used to enhance separation of a pair of parent ions of close mass by sacrificing sensitivity. Several sets of MS—MS data are acquired, while timed gate admits only one parent mass of a pair at a time.

Having described the general method for the purpose of clarity, the detailed embodiments will be first discussed on the level of individual components and only then presented as examples of integrated TOF—TOF apparatus. Though some employed components are well known in the art, their configurations and parameters are altered to suit purposes of the invention. To understand selected compromises, let us first look at major challenges in TOF—TOF method and apparatus.

The method of the invention is highly counterintuitive, since it would be referred to as undoable for multiple reasons. One of ordinary skill in the art would contend that:

- TOF1 resolution would be extremely low; since ion energy spread in the source is comparable to ion energy in the TOF1;
- TOF1 resolution would also suffer because of a large turn around time (time spread, caused by initial velocity spread) in a weak accelerating field;
- ion losses through the TOF1 are expected to be devastating, because of expected large length of TOF1, and because of high divergence of slow ion beam in the TOF1;
- ion losses are expected to be even higher, since vacuum stage of TOF1 and the gas-filled CID cell should be separated by a small aperture; and
- it also looks unlikely to have quick transmission through the CID cell in the time scale of 10 to 100 μs. Most existing CID cells have time spread
- on the order of 200 to 10,000 μs. None of the available commercial data acquisition systems currently employed in TOF technology is capable of handling expected data flow rate.

These are mostly concentrated around TOF1 and arise from knowledge on existing TOF mass spectrometers, operating at high energy. The inventor has realized that multiple schemes of TOF1 are capable of slow separation with moderate resolution. Improvement of TOF1 resolution is made by employing an ion mirror with quadratic potential distribution, known to compensate for energy spread. The phenomenon is similar to elastic oscillations, where period does not depend on oscillation amplitude. Quadratic fields are well explored in TOF art for example, see Makarov et al. in Int J. of Mass Spectrom. and Ion Processes, v. 146/147, 1995, pp. 165–182. Unfortunately, such analyzers also introduce a large beam-divergence. The inventor also realized that low energy TOF could be improved by introducing a radio frequency confinement of the ion beam in at-least one direction. RF confinement eliminates ion beam divergence and also eliminates surface charging, crucial for low energy apparatuses. A novel type of TOF has been found, combining RF confinement with axial DC quadratic potential.

Figure 3:
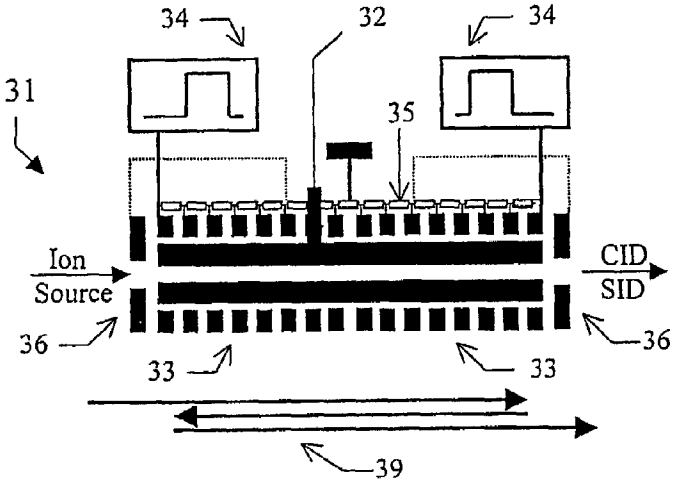
FIG. 3 is a schematic of novel in-line TOF1.
Figure 3:
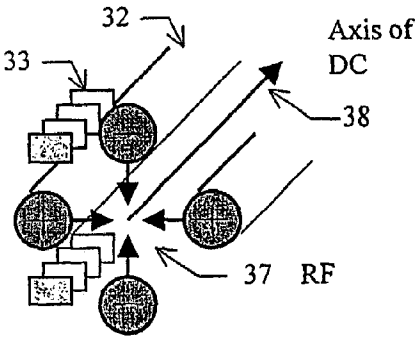

Referring to FIG. 3, the preferred embodiment of novel low energy time-of-flight separator 31 comprises an RF-only multipole 32, two electrostatic mirrors 33 and pulse generators 34. Mirrors are constructed of multiple electrodes, interconnected with a chain of dividing resistors 35. External electrodes of mirrors 33 are connected to pulse generators 34 with the middle electrode of mirrors 33 being ground. The end field is terminated by apertures 36, with the potential adjusted as a portion of full potential on pulse generators 34.

In operation, the RF field provides a radial confinement, shown by arrows 37 on FIG. 3. Radial RF confinement does not affect ion motion along the axis. An axial 15 parabolic electric field is formed by field penetration between multipole rods. The parabolic field provides ion axial reflections with a period, grossly independent on ion energy and proportional to the square root of ion m/z. Pulsing potentials on the mirror ends allows switching between ion injection into TOF1, ion reflections 39 within TOF1 and subsequent ion release on the other end of TOF1. The effective flight path $L1_{EFF}$ is Nπ+1 times higher than TOF1 length L, where N is a number of full turns. Overall, RF confinement and multiple reflections allow prolonged time separation without ion losses, while quadratic potential enhances TOF1 resolution and allows separation of a slow ion beam with a high relative energy spread.

The ideal quadratic scheme is altered by the presence of a free flight segment on the way in and the way out of TOF1. According to the above-cited publication by Makarov et al., even in the case of substantial field free flight, here c.a. 30% of $L_{EFF}$, a mass resolution of 2000 is achievable for ion pulses with relative energy spread up to 50%. To keep free flight path below 0.3 $L_{EFF}$, the scheme requires at least 5 reflections, corresponding to 2 full turns. It helps to increase $L1_{EFF}$ to 7.3L, but reduces mass range of parent ions to a factor of two, i.e., $M_{MAX}/M_{MIN} \leqq 2$.

Figure 4:
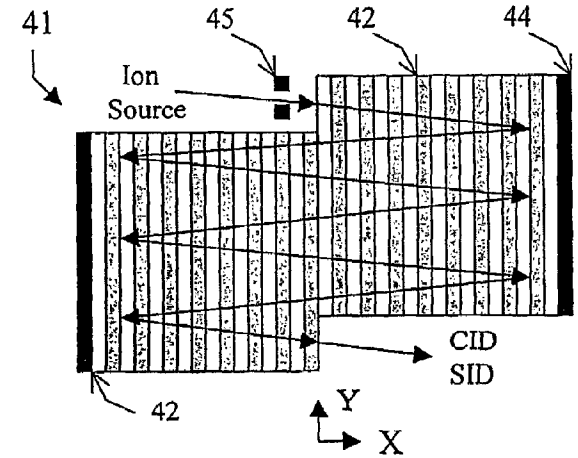
FIG. 4 is a schematic of novel W-shape TOF1.
Figure 4:
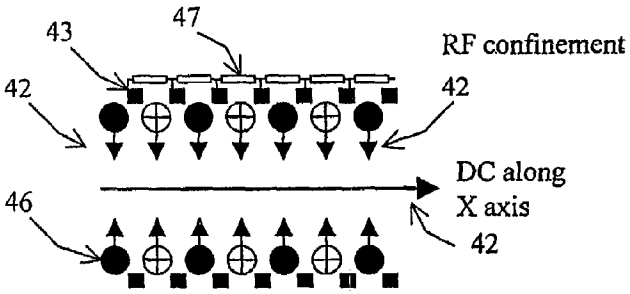

Referring to FIG. 4, another viable embodiment of a novel, low energy, time-of-flight separator 41 comprises an RF channel 42, surrounded by a set of electrostatic electrodes 43, terminating electrodes 44, and a deflector 45. The RF channel is formed by multiple rods 46 with alternating RF phase and aligned along the Y-axis. Electrodes of electrostatic mirrors 43, are also aligned along the Y-axis, and are connected via a chain of dividing resistors 47.

In operation, rods 46 with alternating RF potential form an RF tunnel, confining ions in the Z direction. The potential on electrodes 43, 44 is distributed by a resistor chain to form a quadratic potential along the X-axis with the minimum at the center plane of TOF. The field of external DC electrodes penetrates into the RF channel, providing a weaker but still quadratic potential distribution. Not accounting for fringing fields, there is no field in the Y direction. Ions are injected at a small angle to the X-axis and are deflected by deflection plates 45 to double the deflection angle for ions with mean energy. The deflection reduces Y-spatial spread, caused by X-energy spread. Ion motion is a combined slow drift along the Y direction and of multiple reflections along the X direction. Overall, ion trajectories have a wave shape, ending at the boundary of the RF tunnel. Ions gain some spatial spread at the exit of TOF, which is partially compensated by ion post-acceleration and focusing by a lens.

According to SIMION simulations by the inventor, even at a 50% energy spread the 50×30 cm device allows N=4 to 5 pairs of reflections without mixing ions with adjacent turns. The effective flight path of the device equals to L*π*N, and reaches $L_{EFF}$=7.5 m. The RF field does not limit TOF1 resolution up to R=1000. Obviously a second type of TOF1, which may be called RF confined W-shape TOF, provides a simpler operation and longer flight path in TOF1, thus improving separation in TOF1, mostly limited by ratio of flight time between two TOF analyzers. The complexity of TOF1 could be reduced by using printed circuit board (PCB) assembly.

In both of the described TOF mass separators, the period of each reflection is grossly independent of ion energy and is proportional to the square root of the ion m/z. Ions are confined by the RF field, and ion losses are practically eliminated. Introduction of the novel low-energy TOF analyzers makes the present invention practical, resolving the above-mentioned objections:

a) The high relative energy spread is compensated by quadratic distribution of potential in the ion mirror, created by a DC electric field penetration into multipole guide or tunnel;

b) Because of the TOF1 ability to operate at a high relative energy spread, it can operate at a much lower ion energy and at a much longer time scale, compared to conventional TOF, and, as a result, the apparatus tolerates a much longer ion pulse out of the ion source, and turn around time is no longer an obstacle;

c) Drastic difference in time scales of TOF1 and TOF2 allows time-nested data acquisition;

d) Ion losses are practically avoided by guiding ions within the radio-frequency guide or tunnel;

e) Ion confinement by the RF field and ion post-acceleration in-front of the CID cell allow full transmission of the ion beam into the CID cell;

f) Time spread in the CID cell is reduced by using a short, high pressure cell with an additional axial DC field; and g) A transient recorder with a large and fast averaging memory has been recently introduced by Swiss company Acquiris (www.acquiris.com).

The detailed description continues on the level of individual components: pulsed ion sources, fragmentation cell and TOF2, specifically tailored for purposes of the method and apparatus of the invention. Particular attention will be paid to the issue of time spread.

Figure 5:
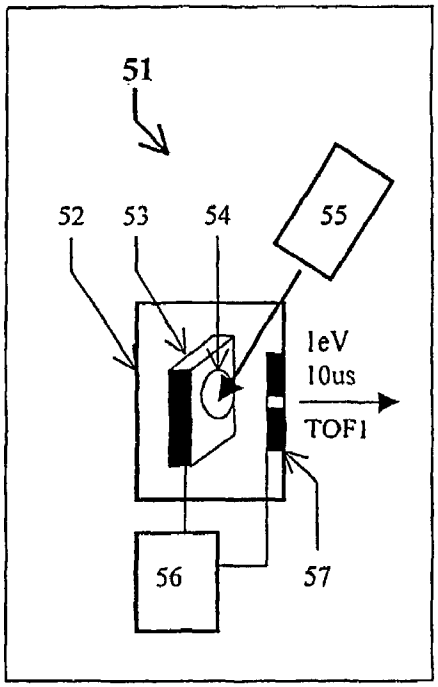
FIG. 5 is a schematics of vacuum pulsed MALDI ion source.

Referring to FIG. 5, the TOF—TOF method and apparatus of this invention employs a pulsed MALDI ion source 51, comprising a source housing 52, a sample plate 53 with analyzed sample 54, a pulsed laser 55, a low voltage power supply 54, and an exit aperture 56.

In operation,, samples for analysis are prepared within matrices known in the art, and deposited on the sample plate 53. The pulsed laser 55 illuminates the sample and generates a short pulse of analyte ions. Ions are known to be ejected with a 300 to 600 m/s velocity, which corresponds to initial ion energy between 0.5 and 1.5 eV for 1 kD. ion. The ions are accelerated by a few votls potential bias. One can estimate that 1 kD ions leave the ion source with few microseconds time spread and less than 1 eV energy spread. The major drawback of a vacuum MALDI ion source is ion temporal instability, well described in conventional, high energy MALDI. The invention is likely to be applicable to softer MALDI ion sources, employing soft matrices or an infra-red laser. Temporal stability of ions is improved by the collisional cooling, described below.

Figure 6:
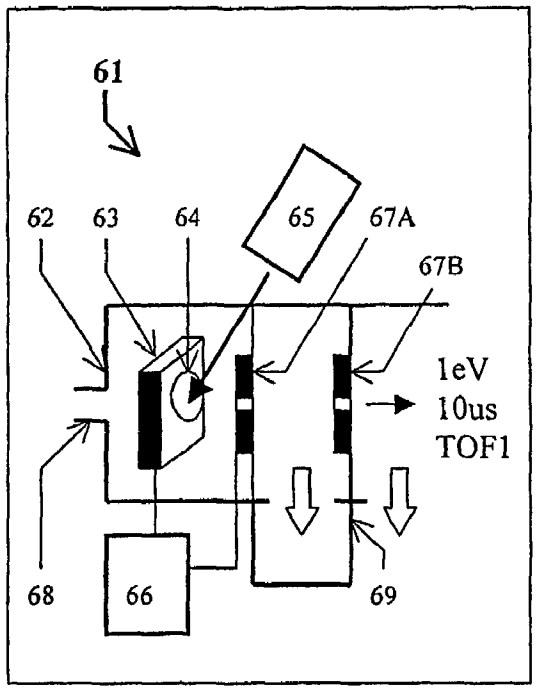
FIG. 6 is a schematic of pulsed MALDI ion source with collisional dampening.

Referring to FIG. 6, the TOF—TOF method and apparatus of the invention employs a gas-filled pulsed MALDI ion source 61. The source 61 comprises features of the vacuum MALDI source, such as a source housing 62, a sample plate 63 with analyzed sample 64, a pulsed laser 65, a low voltage power supply 66, and an aperture 67A. The source 61 also comprises a gas inlet 68, feeding gas into the housing 62, and an additional pumping stage 69, terminated by exit aperture 67B to reduce a gas load on TOF1 pump.

In operation, the source housing 62 is filled with buffer gas via the gas inlet 67. Gas pressure in the source housing is sustained between 0.01 to 1 torr to provide ion collisional cooling (see Verentchikov et al., ASMS Conference 1999 in www.asms.org). A differential pumping system with two 1 mm apertures 67A, B and two conventional 250l/s turbo pumps (one pumping TOF1), sustains vacuum in TOF1 better than 1 E-6 torr. The laser pulse generates a rapid (1 to 3 ns) ion ejection from the sample. The laser 65 is a high-energy laser to enhance ion production. Collisions with the buffer gas relax ion internal energy. Collisions with the gas also dampen ion kinetic energy to nearly thermal energy –0.01 to 0.1 eV, still retaining pulse property of ion beam. Ions are sampled by gas flow through the aperture, assisted by c.a 1V DC bias on the sample plate. Ions are then accelerated to the required kinetic energy, controlled by DC bias between apertures 67A, B, and leave the ion source. Internally cold ions are stable and survive long separation in TOF1 without ion decomposition. Overall, gas dampening in the MALDI source benefits TOF—TOF method of present invention, while leaving time and energy spread within boundaries 10 μs and 1 eV, feasible for slow TOF1 separation.

Figure 7:
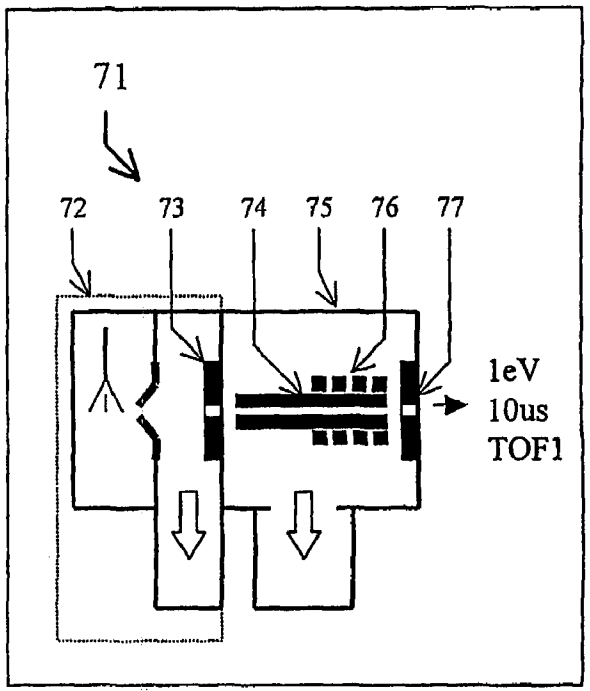
FIG. 7 is a schematic of continuous ion source with pulsing storage quadrupole.

Referring to FIG. 7, the TOF—TOF method and apparatus of the invention uses a pulsed ion source 71, comprising a continuous ion source with soft ionization 72 with an exit aperture 73, and a gas filled RF trapping device 74, enclosed in an additional pumping stage 75. The continuous ion source may be one of the following: electrospray (ESI), APCI, gas filled MALDI, PI or CI. The trapping device may be one of the following: 3-D Paul trap, linear RF only multipole with axial ejection, curved RF multipole with radial ejection. The preference is given to linear quadrupole ion trap with axial ejection. When used, the quadrupole 74 is surrounded by DC electrodes 76 and apertures 73, 77.

In operation, the quadrupole is filled with buffer gas at 1 to 100 mtorr pressure. Differential pumping system 75 reduces gas load on TOF1 pumping. Ions are generated in the ion source 72 and continuously fill the RF-only quadrupole ion guide 74. Gas collisions dampen ion kinetic energy and confine ions along the quadrupole axis and at the bottom of a DC well created by electrodes 76 and aperture 77. Periodically, a potential on electrodes 76 and exit aperture 77 is adjusted to eject the stored ions in the axial direction into TOF1. One can estimate that the ion pulse has less than 1 eV energy spread and less than 10μs time spread.

In all above examples, pulsed ion sources are capable of generating ion pulse with less than 1 eV energy spread and less than 10 μs time spread.

A desired TOF1 mass resolution of 300 to 500, sufficient to separate a group of isotopes, requires 600 to 1000 time resolution. Because of 10 μs initial time spread, the flight time for 1 kD of ions has to be at least 10 ms, achievable at few electron-Volts of ion energy and an effective flight path from 5 to 10 m. The above described multi-turn TOF1 analyzers provide a 10 m effective path within a 0.5 to 1 m device. The next logical question is whether ions could be fragmented within 10 μs, so that primary separation would not be ruined.

Figure 8:
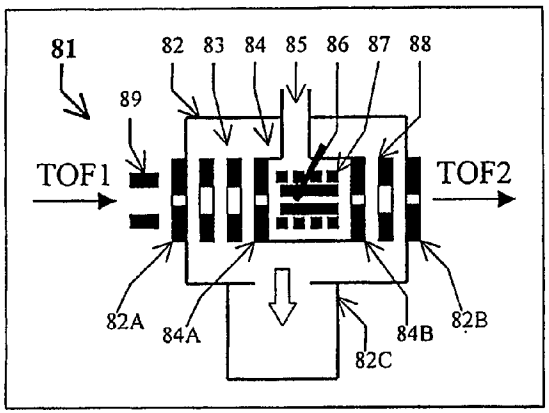
FIG. 8 is a schematic of CID cell.

Referring to FIG. 8, the TOF—TOF method employs a short, high gas pressure CID cell 81 for ion fragmentation. The CID cell 81 comprises a vacuum housing 82, an entrance lens 83, a CID chamber 84 connected to a gas inlet 85, an RF focusing device 86 with optional DC electrodes 87, enclosed in the CID chamber, and exit ion lens 88. The CID cell also comprises an optional timed ion selection gate 89. The gas inlet feeds buffer gas into CID chamber. The CID chamber 83 comprises apertures 83A, B. The vacuum housing 82 comprises apertures 82A, B, and vacuum pump 82C. The RF focusing device is preferably an RF-only quadrupole.

Conventional CID cells, typically 10 to 20 cm long, operate at c.a 10 mtorr gas pressure. In order to provide rapid ion transfer, the CID cell, employed in the present invention, is much shorter, typically 5 to 10mm, and operates at a much higher gas pressure, above 300 mtorr. A high-pressure region is concentrated in the chamber 84 and is surrounded by an additional layer of differential pumping. Apertures 84A, B, typically 1.5mm diameter, limit total gas flow into the vacuum housing to c.a 0.1 torr*L/s. Pump 82C with pumping speed of 300 L/s evacuates vacuum housing to c.a 3E-4 torr. Apertures 82A, B, typically 1.5 mm diameter, further reduce gas flow into TOF1 and TOF2, operating at a gas pressure below 3E-7 torr. To avoid gas discharge, the RF amplitude is reduced below 300 V accompanied by a frequency drop below 1 MHz.

In operation, ions are accelerated in-front of the cell to an energy sufficient for ion fragmentation, typically 50 eV/kDa. Ion packets enter the cell via apertures 82A and 84A and are focused by lens 83. At 300 mtorr gas pressure, gas density equals $n=1E+22m^{-3}$, and an ion of 1 kDa mass with a cross section of $\sigma=100Å^2$ has a mean free path $\lambda=1/n\sigma=0.1$ mm. For a typical quadrupole length of L=1 cm, ions experience c.a. 100 collisions. Number of collisions, 3 times higher than ion/gas mass ratio, is sufficient to ensure fragmentation with subsequent dampening. First energetic collisions convert ion kinetic energy into ion heating, causing ion fragmentation. Once ions lose kinetic energy, subsequent gas collisions stabilize the fragment ions, further dampens their kinetic energy and confine ions to the axis due to the RF field focusing. The phenomenon of collision dampening is well described in U.S. Pat. No. 4,963,736 by D. Douglas and J. French.

Time spread of the ion beam in the CID cell is of significant concern in the present invention. Travel time before the high pressure region is assumed while tuning TOF1, and it creates a time delay only, not a time spread. Gas collisions can cause a significant time spread even in a short CID cell. To reduce the spread, ion passage through the cell is assisted by an electrostatic axial field, created by DC potentials at apertures 84A, B. At a typical quadrupole inscribed diameter D=1 cm and length L=1 cm, fringing fields penetrate into the RF quadrupole, being suppressed by a factor less than 2. Accelerating potential of 20 V can provide ion drag through gas at velocity c.a. 500 m/s, limiting full passage time below 20 μs and time spread below 10 μs. Controlling the passage time helps to bunch the ions (i.e. compress duration of ion pulse) prior to injection into TOF2. The accelerating field in CID cell is modulated, being synchronized (with time shift) to TOF2 injection pulses.

Figure 9:
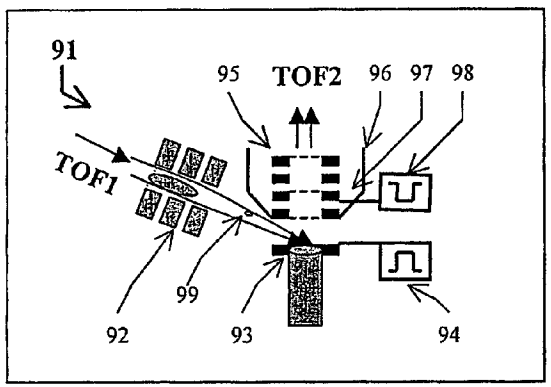
FIG. 9 is a schematic of SID cell.

Referring to FIG. 9, the TOF—TOF method and apparatus of the invention employ a fragmentation cell 91 with surface induced dissociation (SID) for ion fragmentation. The SID cell 91 comprises a bunching (temporal focusing), spatial focusing and steering lens 92, a probe 93, coated with fluorocarbon mono-layer, a pulse generator 94, attached to the probe, and a DC accelerating column 95, surrounded by ground shield 96. The DC accelerating column comprises a mesh 97, connected to a pulse generato 98.

In operation, ion packets of time-separated parent ions are pulse accelerated to c.a. 50eV/kDa specific energy, being bunched by a lens 92. Bunching, previously employed in magnet sector-TOF tandems, is known to compress ion packet duration below dT<1 μs. The lens 92 focuses and steers parent ion packet 99 onto the center of the probe 93. The ion beam impinges the surface at some angle, for example, 45 degrees. Medium energy collisions with a fluorocarbon mono-layer surface are known to induce fragmentation of peptides and small molecular ions. Fragment ions bounce off the surface with c.a. 500 to 2000 m/s velocity, traveling less than 2 mm within dT<1 μs of primary ion packet duration. During impinging, a small retarding potential is applied to the mesh 97, preventing leakage of fragment ions into the TOF2 analyzer. After an appropriate delay, corresponding to impinging of the entire primary ion packet, pulse generators 94 and 98 are triggered, and electric pulses are applied to the probe 93 and the mesh 97. Fragment ions are pulse accelerated into the TOF2 analyzer.

Compared to the CID cell, the SID cell has the advantages of: operating at low pressure and thus reducing requirements on pumping system; removing time spread in fragmentation step; and accepting wider beam of primary ions.

Disadvantages of SID are; poorly characterized fragmentation pattern of medium mass ions; higher energy spread of fragment ions reducing TOF2 resolution; and metastable decay of fragment ions in TOF2 analyzer. The CID cell is better suited for in-line TOF1, while SID cell is better suited for W-TOF1.

Figure 10:
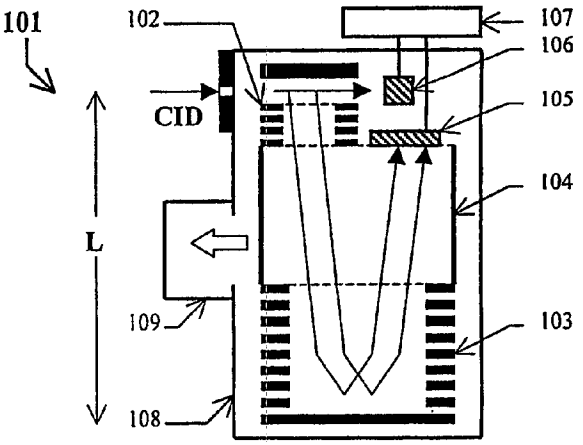
FIG. 10 is a schematic of orthogonal TOF2.

Referring to FIG. 10, the TOF—TOF method and apparatus of the invention employ a conventional orthogonal TOF 101 for mass analysis of fragment ions, preferably in conjunction with the CID cell. The o-TOF 101 comprises an orthogonal pulse accelerator 102, an ion mirror 103, a floating free-flight region 104, a TOF detector 105 and an in-line detector 106. Both detectors are connected to a data acquisition system, comprising a fast averaging transient recorder 107. TOF analyzer 101 is enclosed within a vacuum chamber 108 and is evacuated by a pump 109.

Operation of o-TOF is well described in the art. A continuous or pulsed ion beam, accelerated to c.a 10 eV, enters the acceleration region. Periodic pulses accelerate the ions orthogonal to c.a. 3 keV and inject them into the TOF analyzer. Ions get reflected in the ion mirror and hit the TOF detector 105. A portion of initial ion beam is acquired on the in-line detector 106. To accommodate rapid analysis of fragment ions, parameters of the o-TOF are slightly altered. The analyzer is small—L=10 to 20 cm, and operates at high TOF energy (5 to 15 kV) to accommodate high repetition rate, c.a. 100 kHz. A small size analyzer allows operation at a gas pressure slightly below 1E-5 torr. The conventional TOF analyzer is also modified by using a high current secondary electron multiplier (SEM) or hybrid MCP/PEM as a detector and by using a fast averaging transient recorder for data acquisition system. Small length and short flight time pose a limit on TOF2 resolution. To improve resolution of TOF2, one can increase the flight time in TOF2, while limiting the time windows of admitted ions by one of: 10 μs time gate interleaved between IMS scans and use slower pulse rate of TOF2; pulse TOF2 at 100 kHz rate and divert ions within TOF2 onto several detectors; or pulse TOF2 at 100 kHz rate and use a position sensitive detector in TOF2. TOF2 is optionally equipped with an in-line detector in order to avoid acquiring a signal in blank time, when no ions are coming from TOF1.

Figure 11:
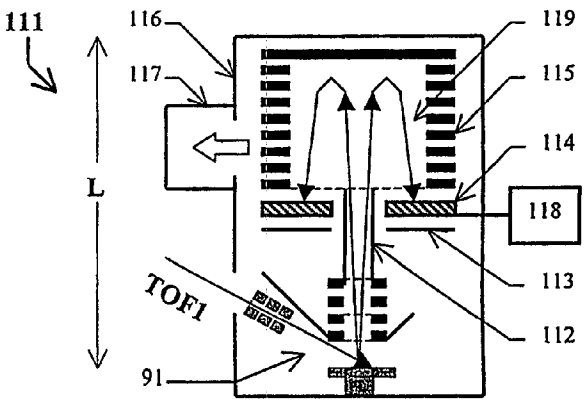
FIG. 11 is a schematic of coaxial TOF2

Referring to FIG. 11, the TOF—TOF method also employs a conventional reflecting TOF 111 for mass analysis of fragment ions, preferably in conjunction with the SID cell. The TOF 111 comprises a built-in SID cell 91, an electrically floated free flight region 112, a detector 114 with a detector shield 113, an ion mirror 115, a vacuum housing 116, a pump 117 and a transient recorder 118 for data acquisition.

In operation, a pulse of fragment ions is accelerated within the SID cell 91, flies through the field free region 112, is reflected in the ion mirror 115 and hits the detector 114. Ion trajectories are shown by lines 119. The signal from the detector is acquired on the transient recorder 118. Again, for the purposes of rapid data acquisition, the analyzer is short, L=10 to 20 cm, and operates at high acceleration potential to accommodate a high repetition rate of 100 kHz.

Having described individual components, it becomes easier to grasp the concept and peculiarities of the integrated TOF—TOF method and apparatus. Below are specific examples of TOF—TOF tandems of the invention, though, not limiting a multiplicity of viable combinations.

Figure 12:
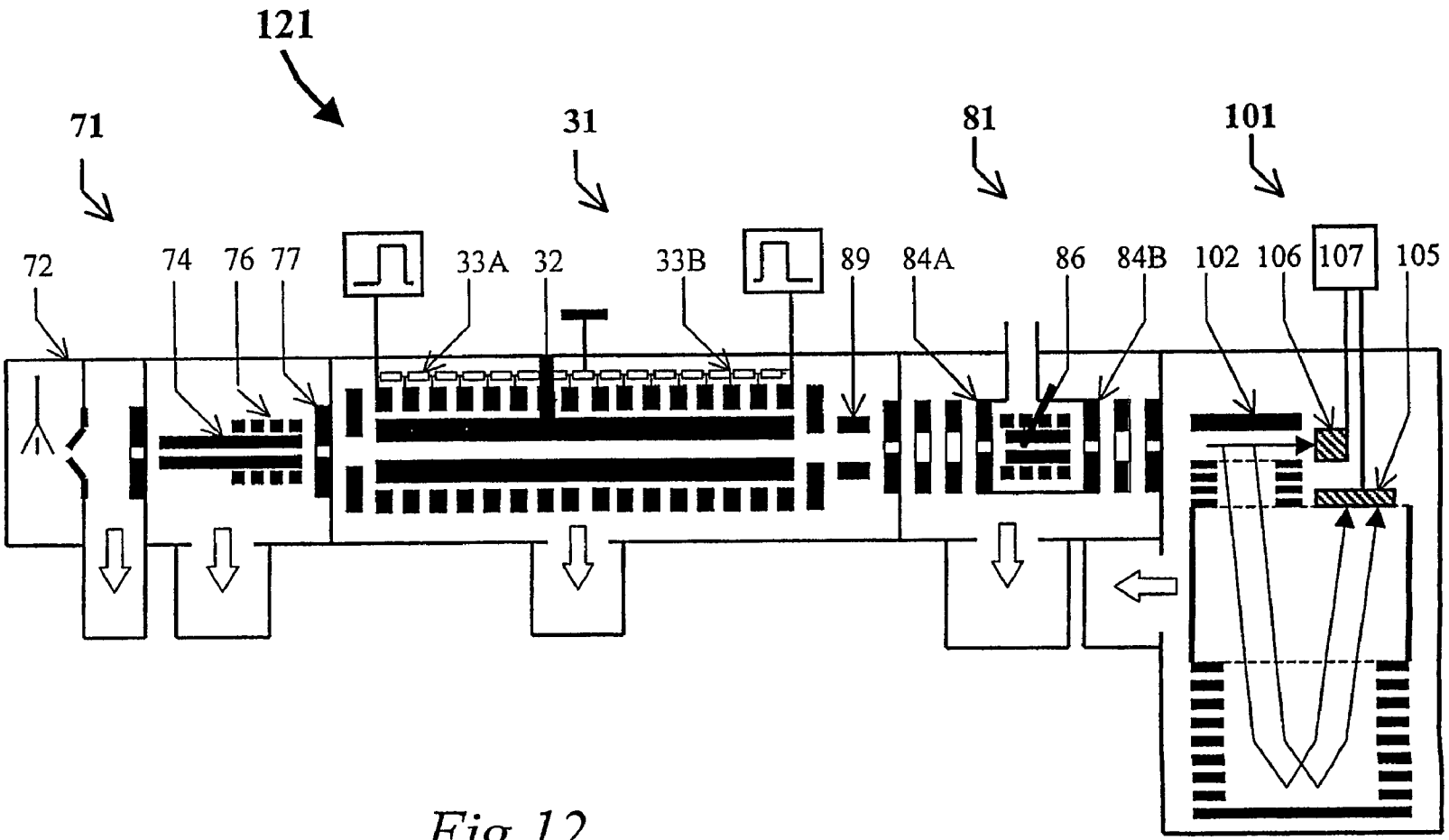
FIG. 12 is a schematic of TOF—TOF with in-line TOF1 and CID cell.

Referring to FIG. 12, one preferred embodiment of TOF—TOF instrument 121 comprises a sequentially connected pulsed source 71 with a continuous ion source 72, a storage quadrupole 74 and electrodes 76,77, an in-line time-of-flight mass spectrometer TOF1 31 with an RF-only quadrupole guide 32, surrounded by two pulsed ion mirrors 33A, B, a short gas-filled collision CID cell 81 with an RF quadrupole 86, surrounded by apertures 84A, B and the second, orthogonal time-of-flight mass spectrometer o-TOF2 101 with a pulse accelerator 102, equipped with an analog data acquiring system 107. Individual components have been described above and are shown on FIGS. 3, 7, 8 and 10, and their previous numbers are retained in further discussion.

In operation, continuous ion source 71 feeds parent ions into the storage quadrupole 74. Once every 10 to 20 ms, ions are ejected from the storage quadrupole by pulsing potentials on DC electrodes 76 and exit aperture 77. An ejected ion packet containing a multiplicity of different parent ions is less than 10 μs long and has less than 1 eV energy spread. Mean energy of the ejected ion pulse is adjusted to c.a. 2 eV by selecting pulse potentials on electrodes 76 and 77. Ions are admitted into the TOF1 separator by dropping the potential of the first mirror 33A. Ions are radially trapped by the quadrupole RF field, but are free to travel along the quadrupole axis. Once parent ions of all masses (limited to the ratio Mmax/Mmin=2) pass the first mirror, the first mirror 33A is turned on. The second mirror 33B has been turned on within the previous cycle. The ions experience multiple reflections, preferably 5 reflections, between the two mirrors with quadratic potential distribution along the TOF1 axis. The period of oscillation is grossly independent on ion energy and is proportional to the square root of parent ion mass. The effective flight path of the analyzer is up to $2\pi+1=7.3$ times longer than the physical length of TOF1. After preferably 5 reflections, ions are released out of TOF1 by lowering the potential of the second mirror 33B. The train of time-separated ion packets enters the CID cell. A typical time scale of time separation is on the order of 10 ms, measured as a flight time of 1 kDa ions, and the duration of each packet, corresponding to parent ion mass, is approximately 10 μs. Parent ions are separated with c.a 1000 time resolution, corresponding to 500 mass resolution.

After leaving TOF1, each ion packet is accelerated to a specific energy of 50 eV/kDa, sufficient to induce fragmentation in gas collisions. Ions are focused by a lens system and injected into a high pressure CID cell via aperture 82A and 84A. The ions fragment in the cell, and fragment ions are collision-dampened and confined by an RF field. The cell is actively emptied by pulsed potential of two CID apertures 84A, B, synchronous and time shifted relative to TOF2 pulses. Ions enter orthogonal acceleration region 102, get injected into TOF2 analyzer, being time separated and, thus, mass analyzed in TOF2. Synchronized injection into TOF2 eliminates time gaps, i.e., almost no fragments are lost between TOF2 pulses. Synchronous injection also improves the duty cycle of TOF2. Most of the fragment ions are contained within the acceleration region 102 at the time of TOF2 pulse.

TOF2 spectra present fragment spectra for every time-separated parent ion mass. Spectra with the same TOF1 tag (i.e., corresponding to parent ions of the same m/z) are summed over multiple source injections. Within 1 second of acquisition the data will contain 1000 fragment spectra, averaged over 100 source injections.

In the above-described apparatus there are three almost equal (c.a. 10 μs) sources of time-spread, deteriorating resolution of TOF1 separation: time-spread gained in the ion source; and time-spread in the CID cell and due to TOF2 digitization (i.e., acquiring spectra at discrete time). Assuming no correlation between those three sources, the overall time spread is estimated as 17 μs (square root of three higher than each spread). The resulting resolution of TOF1 separation becomes equal to 300, which is still considered to be a fair resolution for parent-ion separation. For comparison, TOF1 resolution in commercial MALDI TOF—TOF is c.a 100, and quadrupole resolution in Q-TOF in a high sensitive mode is c.a 300. Resolution of TOF1 of the present invention can be potentially improved by one of the following means: increasing the length of TOF1 above 1 m; optimizing ion energy within TOF1; applying a timed gate with multiple narrow mass windows, interleaved between scans; pulsing TOF2 faster and diverting ions onto several detectors; and using a position sensitive detector in TOF2.

Figure 13:
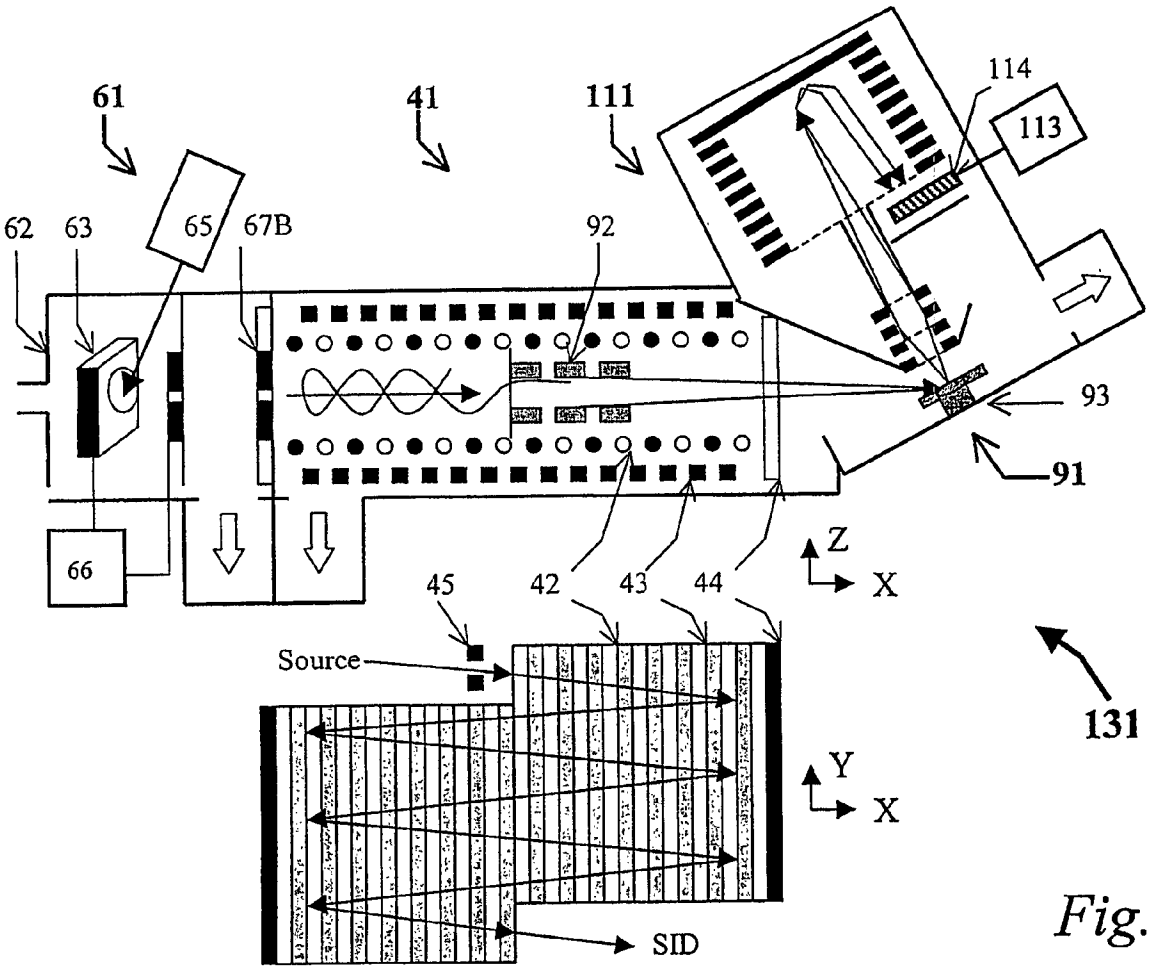
FIG. 13 is a schematic of TOF—TOF with W-shape TOF1 and SID cell.

Referring to FIG. 13, another preferred embodiment of a TOF—TOF apparatus of the invention comprises a gas-filled pulsed MALDI ion source 61, a W-shape TOF1 41, a SID cell 91 and a coaxial TOF2 111. The source 61 comprises a gas-filled chamber 62, a sample plate 63, a laser 65 and a low voltage bias supply 66, connected to the sample plate 63. The TOF1 41 comprises deflection plates 45, two static reflectors 43 with terminating plates 44, and a two-dimensional RF tunnel 42. Static reflectors 43 surround the RF channel 42 to form a quadratic potential distribution. The SID cell 91 comprises a bunching and focusing lens 92 and a probe 93, coated with fluorocarbon mono-layer. The TOF1 111 comprises a secondary electron multiplier-SEM 113, connected to a transient recorder 114. The source 61 and the SID cell 91 are located off-line to allow multiple ion reflections within TOF1 41. The above selected combination of elements is chosen mostly to demonstrate interaction between elements, not described in the previous TOF—TOF embodiment.

In operation, laser 65 pulses produce a short burst of primary ions off the sample plate 63 at a repetition rate of 50 to 100 Hz. The source chamber 62 is filled with gas to relax ion internal energy and prevent ion decomposition. Ions are sampled through a thin gas layer by electric field and gas flow, so that each ion packet remains shorter than 10 μs and has an energy spread less than 1 eV. The ion packet is accelerated into the multi-reflecting TOF1 41 at a small angle to the Y axis by another few volts of potential provided by low voltage bias supply 66. The steering plates 45 double the angle to reduce spatial spread in the X direction, related to the Y axis energy spread. Ion motion within TOF1 has three independent components—oscillation in confining RF field in Z-direction, multiple reflections along the Y axis with a period almost independent on ion energy, and a slow drift along the orthogonal, X axis. After several Y bounces, the ions leave TOF1 and enter the bunching lens 92 of the SID cell 91, being time separated into a train of ion packets and aligned according to their m/z ratio. Multiple reflections at a small ion-energy allow prolonged time separation in the order of 10 ms. Since a quadratic DC field in TOF1 compensates for ion energy spread, separation in TOF1 does not increase the 10 μs time spread of ion packets. Thus, after leaving TOF1, the parent ions are separated with c.a. 300 to 500 mass resolution.

Periodically, for instance, once in every 10 μs, ions are time bunched into c.a 1 μs packets and spatially focused to c.a 1 mm by a pulsed lens 92. Pulse-focused ion packets hit the surface of the SID probe 93 coated with a fluorocarbon mono-layer. Collisions with the surface induce ion fragmentation. Fragments, slowly moving from the surface, are spread for c.a 1 mm within 1 μs time. A delayed electric pulse applied to the probe 93 accelerates the fragment ions and injects them into the second TOF2 111 analyzer. Initial parameters (i.e., parameters prior to the probe pulse) of fragment ions are good enough to carry mass analysis in TOF2 with the resolution of a couple thousand. A signal is detected on the SEM 114 with high dynamic range. A signal is passed to the transient recorder 113, and data are acquired in a time-nested fashion. TOF2 transients, representing fragment spectra of various parent ions, are not mixed together. Each fragment mass spectrum obtains a time tag of TOF1 separation, measured as a time between source pulse and bunching lens pulse. TOF1 time tags carry information on parent ion m/z ratio. TOF2 spectra with the same TOF1 time tag are averaged over multiple laser pulses to improve signal to noise ratio.

It is recognized that a comprehensive TOF—TOF method of the invention could be realized employing simpler static TOF1. Below find several examples of static separators. Retention of an ion beam in a static field requires operation at a relatively higher energy around 100 eV. Millisecond separation time is achieved by extending flight path and using focusing properties of specially designed electrostatic fields.

Figure 14:
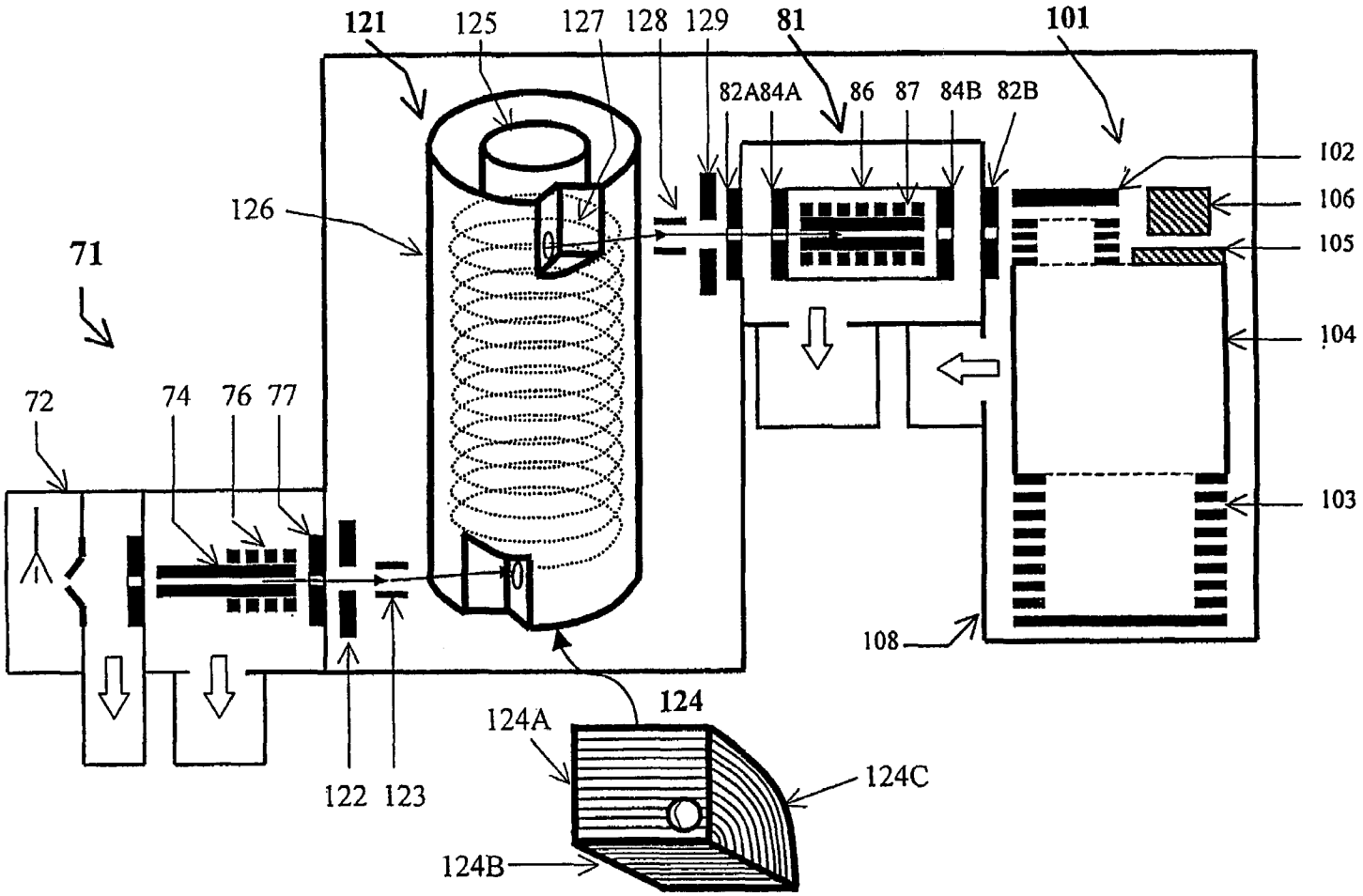
FIG. 14 is a schematic of TOF—TOF with static coaxial TOF1.

Referring to FIG. 14, another preferred embodiment of a low-energy, time-of-flight separator 121 comprises an electrostatic lens 122, a deflector 123 and an analyzer, consisting of an entrance unit 124, two coaxial electrodes 125 and 126 with DC voltage applied between them, and exit unit 127, followed by deflector 128 and lens 129. The described device is known as a "spiratron" and is described in: Bakker J. M. B., The Spiratron. In: Adv. In Mass Spectrom., London, 1971, v.5, pp. 278–280. The novelty is introduced by using the device as a low energy separator in a tandem TOF system.

In operation, an ion beam from a pulsed ion source 71 is transformed by a lens 122 into a much wider beam with proportionally lower angular spread (a "quasi-parallel beam"). This beam is deflected by the deflector 123 to provide a controlled angle of inclination $\alpha$ relative to the axis of the electrodes 125 and 126. The same effect may be achieved, for example, by positioning electrodes 125 and 126 at a fixed angle. The ion beam would enter the electrostatic radial field between electrodes 125 and 126 via an aperture in the entrance unit 124. One preferred embodiment of the entrance unit 124 includes 3 double-sided printed-circuit boards (PCB). Outside surfaces of these boards would face deflector 123 and have metallization on them to create an equi-potential surface. The opposite surfaces of these boards would face the gap between electrodes 125 and 126 and contain a set of metallization strips. These strips are connected to a resistive voltage divider that provides a voltage distribution matching the ideal logarithmic voltage distribution between electrodes 125 and 126 and thus minimizing perturbation of this field along ion trajectories. Exit unit 127 may have a similar construction.

After the ions pass through entrance unit 124, they start moving along a spiral trajectory, wound around electrode 125, and separated in time-of-flight according to their mass-to-charge ratios. To minimize ion beam size, this spiral needs to be circular. This is achieved when voltage U between electrodes 125 and 126 corresponds to the mean ion energy $V_1$ as defined by the equation $$U = 2V_1 \ln\left(\frac{r_2}{r_1}\right)$$

where $r_1$ and $r_2$ are the radii of electrodes 125 and 126, respectively. After a number of rotations, the ions exit the field through the exit unit 127, having drifted distance H along the axis. Construction of the exit unit 127 is similar to that of the injection unit 124. The maximum number of rotations is limited mainly by the full angular spread $\Delta\alpha$ of the ion beam ($\Delta\alpha<<1$) that in turn is limited by the effective temperature of the initial ion beam kT as defined by the equation $$\Delta\alpha \approx \frac{p}{M}\sqrt{\frac{kT}{V_1}}$$

where M is magnification of lens 122 and coefficient p depends on the required confidence level (p≈4 for 95% of ions, p≈5 for 99% of ions, and p≈6.6 for 99.9% of ions). In the present example we choose M=5 and p=5, which will limit $^{\Delta\alpha}$ to ¼5, i.e. approximately 1 degree. Then the maximum total length of trajectory is $$L_1 \approx \frac{H}{\Delta\alpha \cdot \cos(\alpha)} \approx \frac{H \cdot M}{p}\sqrt{\frac{V_1}{kT}}$$

For example, for length H=0.5 m, kT=0.05 eV, V1=100 V, M=5, then total flight path is L1≈22 m. Let us define ratio of time scales between TOF1 and TOF2 as:

$$\text{Ratio} = \frac{1}{2}\cdot\frac{TOF1}{TOF2} = \frac{1}{2}\cdot\frac{L_1}{L_2}\sqrt{\frac{V_2}{V_1}}$$

This value defines the limit on the maximum mass resolving power of TOF1 caused by the pulsed nature of TOF2. For the parameters above, effective path length of TOF2 L2=0.5 m and mean acceleration voltage V2=5000 V, Ratio≈150, which corresponds to mass resolution of TOF1 separation R~75. Since resolution is also limited by relative energy spread of ion beam to c.a. R=100, it is not worth using longer devices. Though resolution is inferior, compared to above described TOF1 spectrometers, the spiratron device has an advantage of simplicity, higher operation energy and it works without stroboscopic techniques prior to TOF2. Resolution of 75 is still useful in separating a complex mixture of primary ions. For comparison separation in a PSD MALDI has resolution from 50 to 100, and separation in a typical triple quadrupole experiments is typically around 300.

Mean radius of the spiral r0 could be chosen on the basis of practical constraints, mainly the period d of metallization strips on boards 124A–124C, For example, for r0=80 mm, step of the spiral is 15 mm. If d=3 mm, the resulting gap between the beam and plate 124C ensures sufficient attenuation of fringing fields even for initial beam size 3–4 mm after lens 122 (for M=5, this corresponds to ion beam diameter of 0.6–0.8 mm on the exit from the source 71).

The novel static low energy TOF can be coupled to any of above described fragmentation means and TOF2 spectrometers or fragment analysis. Referring to FIG. 14 the TOF1 121 is coupled to the CID cell 81 and the orthogonal TOF 101. The major challenge in this combination is to focus the primary beam onto the entrance of the CID cell. Though ion beam has high 100 eV energy and beam gets wider at the exit, the beam is grossly parallel and can be well focused onto a small aperture by a conventional lens.

Figure 15:
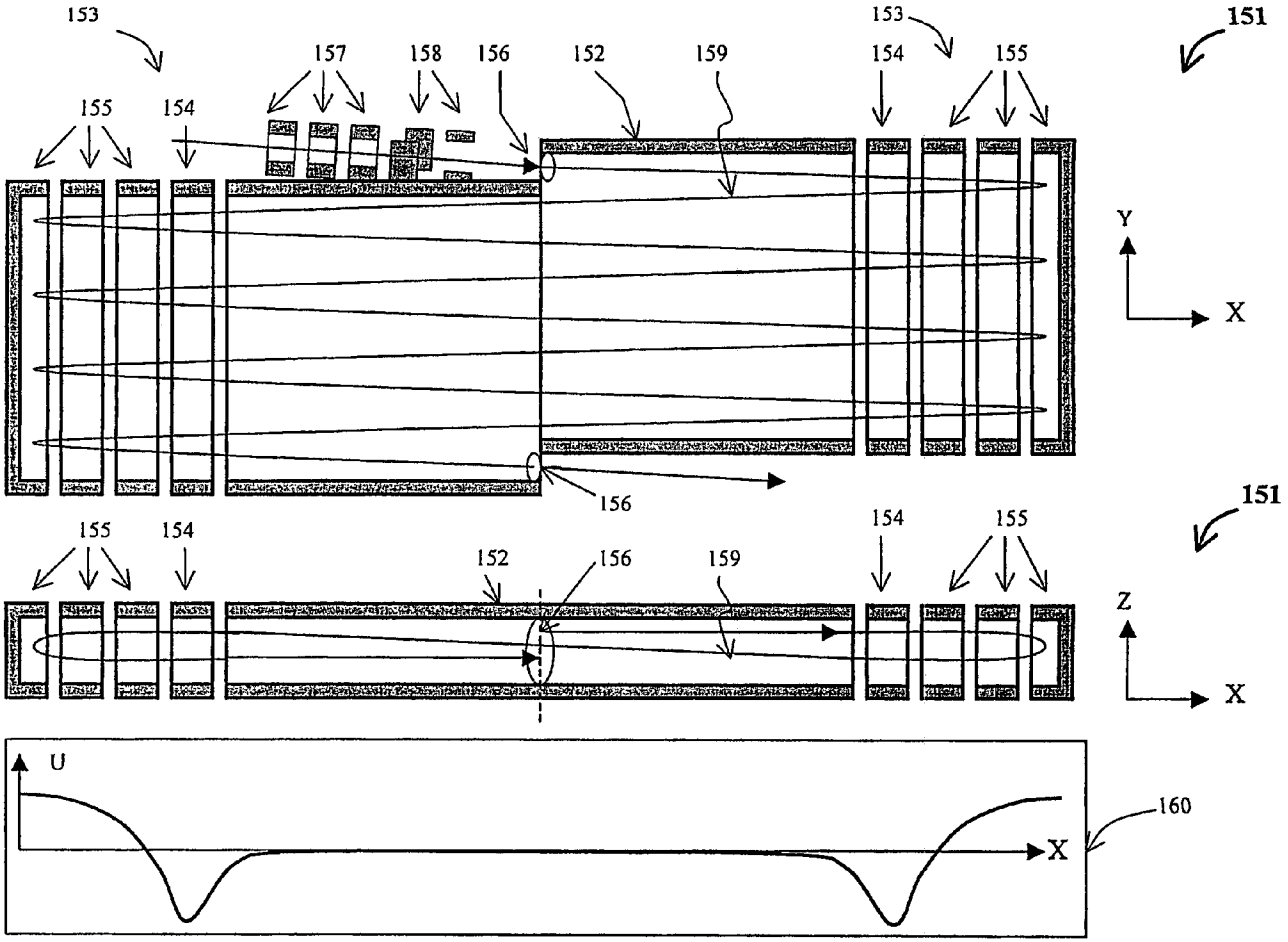
FIG. 15 is a schematic of planar electrostatic multi-pass TOF1.

Referring to FIG. 15, another preferred embodiment of the first (i.e. TOF1) time-of-flight separator of the invention 151, also known as an 'electrostatic multi-pass separator', comprises a free flight channel 152, and two electrostatic mirrors, composed of focusing electrodes 154, and reflector electrodes 155. The free flight channel 152 has entrance and exit windows 156. All electrodes are extended along the Y-axis such that the electrostatic field is two-dimensional in the area of the ion path. A pulsed ion beam is introduced into the multi-turn electrostatic TOF 151 via a spatial focusing lens 157 and a set of steering plates 158A, B. The path of the ions is shown by the line 159. A typical axial potential distribution U(x) is shown by the graph 160.

In operation, the ion pulse is focused into a parallel beam by lens 157 and is steered by plates 158A, B. The beam is introduced into the separator 151 via the entrance window 156 at a small angle to X-axis. The ions experience multiple reflections along the X-axis, while slowly drifting along Y-axis. After multiple full turns (each full turn is formed by a pair of reflections) the ions leave separator 151 through the exit window 157, being time separated according to their m/z ratio. The number of full turns depends on the injection angle which is adjustable by potentials on the steering plates.

Electrostatic mirrors are designed similar to the mirror in grid-less TOF devices. Electrostatic potentials, applied to the mirror electrodes, are tuned to satisfy conditions of spatial focusing and time-of-flight focusing. Graph 160 shows the type of axial potential distribution U(x) satisfying those requirements. To provide spatial focusing along the Z direction, each of the electrostatic mirrors 153 forms a lens with a focal point, located near the center plane of the free flight region (shown by a dashed line). The ion beam (line 159) starts as a parallel beam at the entrance window 156. After the first reflection in the right side mirror, the beam is focused into a point at the middle plane. Note, focusing of all ions is presented on the drawing by a single ion trajectory intersecting the axis. After reflection in the left hand mirror, the beam is again converted into a parallel beam.

According to the inventor's ion optics simulation using the SIMION program, the spatial focusing in the specific TOF1 151 is compatible with time-of-flight focusing in at least the first order, i.e., the first derivatives of flight time on the initial energy and on the orthogonal displacement are equal to zero. The ion beam remains confined only if initial spatial spread is under 5% of TOF1 width and angular spread is below 2 degrees. For energy spread under 3%, the time of flight resolution of TOF1 exceeds 10,000. Such initial conditions are realistic for an ion beam accelerated to approximately 30 eV after pulse ejection out of linear storing quadrupole.

Operation at a relatively higher energy (30 to 100 eV), compared to other embodiments, requires a longer ion path in TOF1 (30 to 100 m) to achieve a millisecond time scale separation in TOF1. The ion path could be easily extended because of the low complexity of TOF1 design and its static operation. An instrument of 1 m length with approximately 20 full ion turns corresponds to at least a 50 m effective flight path.

Figure 16:
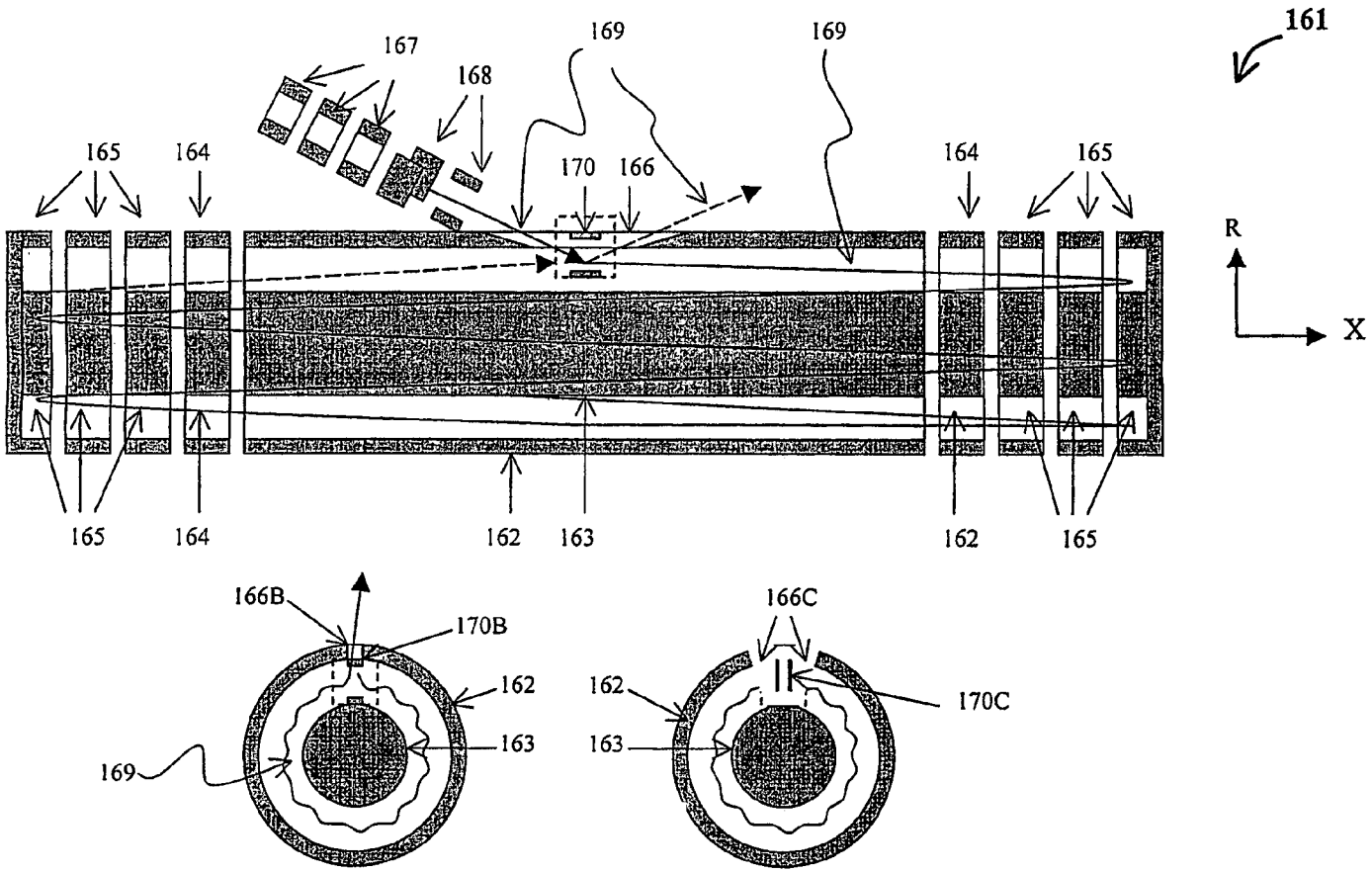
FIG. 16 is a schematic of cylindrical electrostatic multi-pass TOF1.

Referring to FIG. 16, another preferred embodiment of the invention presents modified electrostatic multi-pass separator, formed by folding two dimensional fields into a cylindrical field. In this embodiment, a so called cylindrical multi-pass separator 161 is provided for the purpose of compact design, wherein each elongated electrode is converted into a pair of coaxial cylinders—internal and external. The separator 161 comprises a free-flight channel, formed by cylinders 162,163, and two electrostatic mirrors, composed of focusing cylinders 164, and reflector cylinders 165. The external cylinder of free-flight channel 162 has entrance and exit windows 166, equipped with beam deflector 170. A pulsed ion beam is introduced into separator 161 via a spatial focusing lens 167, a set of steering plates 168, through entrance window 166 and deflector 170. The ion path is shown by the line 169.

In operation, the cylindrical separator is very similar to the above-described two-dimensional electrostatic multi-pass separator. Ions are forced to make multiple bounces between mirrors, while being spatially focused by lens electrodes. In order to retain ions near the same radius of orbit, an additional potential is applied between the external and internal cylinders 162 and 163. A radial deflecting potential could be also applied between the external and internal cylinders of electrodes 164 and 165.

The entrance and exit of ions can be organized in multiple ways. FIG. 16 shows an example of ion introduction through a slit-shaped window 166B with subsequent horizontal deflection, aligning ion beam along the X-axis. To reduce fringing fields, the deflector 170B is surrounded by mesh. FIG. 16 also shows an example of ion introduction along the X-axis through a segment cut-out in the entire cylindrical analyzer. A beam is injected into the analyzer after horizontal deflection by plates 170C. Field distortion is minimized by using double-sided PCB, equi-potential within cut-out and with distributed potentials on the side oriented towards cylindrical analyzer. The above-described electrostatic multi-pass separators are suggested for use, in comprehensive tandem TOF spectrometer of the invention in a variety of combinations with earlier described pulsed ion sources, fragmentation cell and fast TOF2.

The presented examples of TOF1 separators, including separators with RF confinement, spiratron and static multi-pass separators, do not exhaust all the possibilities of TOF1, providing prolonged time separation, while retaining ion beam, but rather prove the feasibility of the general method of comprehensive tandem TOF mass spectrometry of the invention.

The tandem TOF spectrometers of the invention described above provide increased speed and sensitivity of analysis as compared to existing TOF—TOF mass spectrometers. This improvement is achieved by employing the principle of time-nested acquisition, applied for the first time to tandem TOF. Ion pulses from the ion source are fully utilized and multiple parent ions are analyzed per single source pulse. The invention also improves the rate of MS—MS information, compared to the closest prototype—IMS-TOF also employing time-nested acquisition. The improvement is made by getting much higher resolution at the step of parent ion separation and thus, providing analysis of more complex mixtures.

The greater speed provided by tandem MS—MS analysis opens opportunities for coupling multi-step liquid-phase separations with tandem MS analysis at a realistic time scale. Such separation techniques may include affinity separation, liquid phase chromatography (LC) and capillary electrophoresis (CE). High speed LC and CE separation at few minutes time scale became routine in LC-MS analysis. However, LC-MS—MS analysis, usually slowed down by low speed of MS—MS stage, is no longer the case after introducing the comprehensive TOF—TOF method and apparatus of the invention.

Having described the different embodiments of the invention along with some examples of combining useful elements, it will now become apparent for one skilled in the art that other embodiments incorporating the concepts may be used. It is felt, therefore, that these embodiments should not be limited to the disclosed embodiments, but rather should be limited only by the spirit and the scope of the following claims.

What is claimed is:

1. A tandem mass spectrometer comprising:

a pulsed ion source;

a parent ion separator in the form of a first time-of-flight mass spectrometer;

a fragmentation cell;

a second time-of flight mass spectrometer; and a time nested data acquisition system acquiring fragment mass spectra for multiple parent ions, wherein for ions of a same mass-to-charge ratio, a time-of flight in said first time-of-flight mass spectrometer is significantly greater than the sum of a passage time through said fragmentation cell and the time-of-flight in said second time-of flight mass spectrometer.

2. The tandem mass spectrometer of claim 1, wherein the time-of-flight in said first time-of-flight mass spectrometer is at least 10 times greater than the time-of-flight in said second time-of-flight mass spectrometer.

3. The tandem mass spectrometer of claim 1, wherein an average ion energy in said first time-of-flight mass spectrometer is at least 100 times less than that in said second time-of-flight mass spectrometer.

4. The tandem mass spectrometer of claim 1, wherein said pulsed ion source comprises a MALDI ion source having a pressure of about 0.1 mbar.

5. The tandem mass spectrometer of claim 1, wherein said pulsed ion source comprises a radio frequency (RF) storage device and a continuous ion source selected from the group of an electrospray source, a MALDI ion source, an electron impact ion source, and electron impact with one of a chemical and photo ionization ion source; wherein ions are continuously supplied from said ion source to become accumulated and pulse-ejected from said storage device.

6. The tandem mass spectrometer of claim 5, wherein said storage device comprises at least one linear multipole, supplemented by at least one DC electrode, creating a non-zero axial electric field.

7. The tandem mass spectrometer of claim 1, wherein said first time-of-flight mass spectrometer comprises a linear multipole surrounded by a plurality of pulsed mirrors with an axial quadratic electric field.

8. The tandem mass spectrometer of claim 1, wherein said first time-of-flight mass spectrometer comprises a two-dimensional ion tunnel surrounded by a plurality of two-dimensional DC mirrors with a quadratic electric field.

9. The tandem mass spectrometer of claim 1, wherein said first time-of-flight mass spectrometer comprises at least a pair of coaxial electrodes with DC voltage applied therebetween and wherein ions are injected between said electrodes at an angle.

10. The tandem mass spectrometer of claim 9, wherein ions enter and exit a gap between said electrodes through cut-off boundaries formed by a plurality of double-sided, printed-circuit boards.

11. The tandem mass spectrometer of claim 1, wherein said first time-of-flight mass spectrometer comprises a planar multi-pass electrostatic time-of-flight mass spectrometer having a two-dimensional free flight channel and a plurality of planar focusing electrostatic mirrors defined by focusing and reflecting electrodes.

12. The tandem mass spectrometer of claim 1, wherein said first time-of-flight mass spectrometer comprises a cylindrical multi-pass electrostatic time-of-flight mass spectrometer having at least a pair of coaxial cylinders with radial deflection and a plurality of focusing electrostatic mirrors formed by coaxial cylinders.

13. The tandem mass spectrometer of claim 1, further comprising a timed gate between said first time-of-flight mass spectrometer and said fragmentation cell and adapted to transmit ions within at least one time window.

14. The tandem mass spectrometer of claim 13, wherein said fragmentation cell stores fragment ions using a modulation of an axial DC field within said cell and ejects a pulsed beam synchronized with pulses from said second time-of-flight mass spectrometer.

15. The tandem mass spectrometer of claim 13, wherein said first time-of-flight mass spectrometer comprises one of a plurality of reflectors forming a quadratic potential distribution along an ion path and having a length greater than lm, using said timed gate with multiple time windows.

16. The tandem mass spectrometer of claim 1, wherein ions in said fragmentation cell comprise an energy adjusted by an electrostatic offset between said first time-of-flight mass spectrometer and said fragmentation cell.

17. The tandem mass spectrometer of claim 1, wherein said fragmentation cell comprises a collision-induced dissociation cell filled with a gas and at least one multipole supplemented by at least one electrode.

18. The tandem mass spectrometer of claim 17, wherein an ion packet within said collision-induced dissociation cell includes a time spread reduced by using a cell of less than 1 cm in length and a pressure greater than or equal to 100 mtorr.

19. The tandem mass spectrometer of claim 1, wherein said fragmentation cell comprises a pulsed-temporal and spatial-focusing lens and a target coated with a fluorohydrocarbon monolayer.

20. The tandem mass spectrometer of claim 1, wherein said second time-of-flight mass spectrometer comprises a time-of-flight mass spectrometer having orthogonal time injection.

21. The tandem mass spectrometer of claim 1, wherein said second time-of-flight mass spectrometer comprises a high current detector and transient recorder.

22. The tandem mass spectrometer of claim 1, further comprising an in-line detector sequentially connected to said first time-of-flight mass spectrometer.

23. A method of comprehensive tandem mass spectroscopy analysis, comprising the steps of:

(1) ejecting a plurality of parent ions having various mass-to-charge ratios from a pulsed ion source;

(2) separating said parent ions as a function of time within a first ion separator;

(3) fragmenting the time-separated parent ions;

(4) analyzing the fragmented parent ions within a first time-of-flight mass spectrometer; and (5) time nesting the fragmented parent ion spectra acquisition corresponding to multiple parent ions per ion pulse without mixing fragment spectra of different parent ions, wherein to improve sensitivity and throughput of tandem mass spectroscopy analysis, the step of time separating occurs within a second time-of-flight mass spectrometer and wherein the time of said parent ion separation significantly exceeds the time of both fragmentation and fragment mass analysis.

24. The method of comprehensive tandem mass spectroscopy analysis of claim 23, wherein said time of flight in said second time-of-flight mass spectrometer is at least 10 times greater than in the said first time-of-flight mass spectrometer.

25. The method of comprehensive tandem mass spectroscopy analysis of claim 23, wherein the step of pulse ejecting parent ions is performed in a MALDI ion source under vacuum of approximately 100 mtorr.

26. The method of comprehensive tandem mass spectroscopy analysis of claim 23, wherein the step of pulse ejecting parent ions includes pulsed ejection from a storage quadrupole, while ions are introduced into said storage quadrupole from a continuous ion source selected from the group of an electrospray source, a MALDI ion source having a pressure ranging between 10 mtorr and 1 atm, an electron impact ion source, an electron impact having one of a chemical and photo ionization ion source.

27. The method of comprehensive tandem mass spectroscopy analysis of claim 23, wherein the step of time separating parent ions occurs in a quadratic DC field wherein an energy of ions in said second time-of-flight mass spectrometer is at least 100 times less than in said first time-of-flight mass spectrometer.

28. The method of comprehensive tandem mass spectroscopy analysis of claim 27, wherein said step of time separating parent ions in said quadratic DC field is assisted by confining an RF field in at least one dimension, orthogonal to said quadratic DC field.

29. The method of comprehensive tandem mass spectroscopy analysis of claim 28, wherein said step of confining in said RF field is achieved along an axis where ions are injected from one end of said RF field zone and after multiple reflections in said quadratic DC field are released from an opposite end.

30. The method of comprehensive tandem mass spectroscopy analysis of claim 28, wherein the step of confining in said RF field occurs along a two-dimensional plane; and said ions are injected at an acute angle to said second time-of-flight mass spectrometer axis parallel to a gradient of said DC field; whereby said ions experience multiple reflections in said DC field while drifting in an orthogonal direction towards an exit of said RF field.

31. The method of comprehensive tandem mass spectroscopy analysis of claim 23, wherein said step of time separating said parent ions occurs in an electrostatic field wherein said energy of said parent ions in said second time-of-flight mass spectrometer is at least 10 times less than in said first time-of-flight mass spectrometer, and wherein the effective flight path in said second time-of-flight mass spectrometer is at least 30 times greater than in said first time-of-flight mass spectrometer .

32. The method of comprehensive tandem mass spectroscopy analysis of claim 23, wherein said step of time separating said parent ions occurs in an electrostatic field created by a plurality of coaxial electrodes, wherein said parent ions are injected into said electrostatic field at an angle to an electrode axis, and wherein a disturbance of said electrostatic field at its boundaries is reduced by at least one double-sided, printed-circuit board.

33. The method of comprehensive tandem mass spectroscopy analysis of claim 23, wherein said step of time separating said parent ions occurs in a planar electrostatic field formed by a planar free flight channel and a plurality of planar focusing ion mirrors; and wherein said parent ions are injected at an acute angle to said second time-of-flight mass spectrometer axis and experience multiple bounces between said mirrors.

34. The method of comprehensive tandem mass spectroscopy analysis of claim 23, wherein said step of time separating said parent ions occurs in a cylindrical electrostatic field formed by a plurality of coaxial cylinders; wherein in at least one pair a radial field is applied; and wherein said parent ions are injected at an angle relative to said second time-of-flight mass spectrometer axis and experience multiple bounces between a plurality of ion mirrors.

35. The method of comprehensive tandem mass spectroscopy analysis of claim 23, further comprising the step of resolving the time separation of ions in said first time-of-flight mass spectrometer by sampling a plurality of time windows before submitting ions to said fragmenting step.

36. The method of comprehensive tandem mass spectroscopy analysis of claim 23, where said fragmenting step is achieved in one of the following processes: in energetic collisions with gas, in collision with a surface, or by light.

37. The method of comprehensive tandem mass spectroscopy analysis of claim 23, wherein the step of analyzing includes acquiring parent mass spectrum in said second time-of-flight mass spectrometer, while using said first time-of-flight mass spectrometer in a pass mode, and by sampling time windows in front of a collision cell corresponding to arrival of meaningful parent ions and acquiring fragment spectra for those time windows only, said time windows being selected on the fly, based on parent masses from a first stage of measurements.

38. The method of comprehensive tandem mass spectroscopy analysis of claim 23, further comprising the step of reconstructing a spectrum of parent ions having a predetermined set of fragment ions using a full tandem mass spectrometer data set.

39. The method of comprehensive tandem mass spectroscopy analysis of claim 23, and further comprising the step of continuously introducing a flow of solvent from at least one liquid chromatograph input into a tandem mass spectrometer.

* * * * *

UNITED STATES PATENT AND TRADEMARK OFFICE

CERTIFICATE OF CORRECTION

PATENT NO. : 7,196,324 B2
APPLICATION NO. : 10/520871
DATED : March 27, 2007
INVENTOR(S) : Anatoli N. Verentchikov It is certified that error appears in the above-identified patent and that said Letters Patent is hereby corrected as shown below:

In Col. 1, line 63
replace “extended”
with --extended to.--

In Col. 1, line 66
replace “Hughes R, J.”
with --Huges R. J..--

In Col. 5, line 55
replace “schematics”
with --schematic.--

In Col. 7, line 7
replace “difference”
with --differences.--

In Col. 9, line 48
replace “equals to”
with --equals.--

In Col. 10, line 53
replace “with”
with --with a.--

In Col. 10, line 67
replace “c.a”
with --c.a.--

In Col. 11, line 16
replace “RF”
with --RF--.--

In Col. 12, line 48
replace “generato”
with --generator.--

UNITED STATES PATENT AND TRADEMARK OFFICE

CERTIFICATE OF CORRECTION

PATENT NO. : 7,196,324 B2
APPLICATION NO. : 10/520871
DATED : March 27, 2007
INVENTOR(S) : Anatoli N. Verentchikov It is certified that error appears in the above-identified patent and that said Letters Patent is hereby corrected as shown below:

In Col. 17, line 58
replace "experiments"
with --experiment.--

Signed and Sealed this

Thirty-first Day of July, 2007

JON W. DUDAS
*Director of the United States Patent and Trademark Office*